US009011296B2

(12) United States Patent
Peralo

(10) Patent No.: US 9,011,296 B2
(45) Date of Patent: Apr. 21, 2015

(54) THERAPEUTIC EXERCISE APPARATUS WITH MULTIPLE SELECTIVELY INTERLOCKABLE SLIDING PLATFORMS

(76) Inventor: Charles A. Peralo, Rock Hill, NY (US)

( * ) Notice: Subject to any disclaimer, the term of this patent is extended or adjusted under 35 U.S.C. 154(b) by 260 days.

(21) Appl. No.: 13/559,027

(22) Filed: Jul. 26, 2012

(65) Prior Publication Data

US 2014/0031175 A1 Jan. 30, 2014

(51) Int. Cl.
*A63B 22/00* (2006.01)
*A61H 3/00* (2006.01)
(Continued)

(52) U.S. Cl.
CPC ..... *A61H 1/02* (2013.01); *A63B 21/0552* (2013.01); *A63B 21/068* (2013.01); *A63B 21/1469* (2013.01); *A63B 21/1488* (2013.01); *A63B 22/0076* (2013.01); *A63B 22/0087* (2013.01); *A63B 22/203* (2013.01); *A63B 23/0211* (2013.01); *A63B 23/0244* (2013.01); *A63B 23/03525* (2013.01); *A63B 23/03533* (2013.01); *A63B 23/03541* (2013.01); *A63B 23/0355* (2013.01); *A63B 23/03575* (2013.01); *A63B 23/0488* (2013.01); *A63B 23/1236* (2013.01); *A63B 23/1254* (2013.01); *A61H 2201/1269* (2013.01); *A61H 2201/1633* (2013.01);
(Continued)

(58) Field of Classification Search
CPC ..... A63B 22/0087; A63B 2208/0252; A63B 23/0355; A63B 23/03566; A63B 2225/10; A63B 23/03558; A63B 23/0494; A61G 7/1034; A61G 3/0254; A61H 1/024; A61H 1/0255
USPC ..... 482/66, 70–71, 91–96, 121–139, 482/145–148, 907; 434/255; 601/33
See application file for complete search history.

(56) References Cited

U.S. PATENT DOCUMENTS 339,638 A * 4/1886 Goldie ..... 482/96
2,224,445 A 12/1940 Parker
(Continued)

FOREIGN PATENT DOCUMENTS

JP 6105930 4/1994
JP U3145983 10/2008
(Continued)

OTHER PUBLICATIONS

PCT/US2014/049658, filed Aug. 5, 2014.
(Continued)

*Primary Examiner* — Oren Ginsberg
*Assistant Examiner* — Joshua Lee
(74) *Attorney, Agent, or Firm* — David M. Quinlan, P.C.

(57) ABSTRACT

An exercise apparatus comprises a frame having two parallel tracks, two platforms mounted on the first track by a sliding bearing, and two platforms mounted on the second track by a sliding bearing. The tracks are spaced apart a sufficient distance to permit the platforms on different tracks to move freely past each other. A transverse interlock allows selective connection of platforms on different tracks for movement together and a longitudinal interlock allows selective connection of platforms on the same track for movement together. The frame includes cross braces connecting the rails at their ends, and the rails, cross braces, and platforms all include connecting points for permitting the user to selectively connect to and between the frame and the platforms a variety of exercise accessories or appliances. The accessories can include elastic resistance bands, cord and pulley assemblies, handles, weights, and appliances for administering physical therapy.

20 Claims, 15 Drawing Sheets

(51) Int. Cl.

| | |
|---|---|
| ***A47D 13/04*** | (2006.01) |
| ***A63B 69/18*** | (2006.01) |
| ***A63B 21/02*** | (2006.01) |
| ***A61H 1/02*** | (2006.01) |
| ***A63B 21/055*** | (2006.01) |
| ***A63B 21/068*** | (2006.01) |
| ***A63B 22/20*** | (2006.01) |
| ***A63B 23/035*** | (2006.01) |
| ***A63B 21/04*** | (2006.01) |
| *A63B 21/00* | (2006.01) |
| *A63B 23/02* | (2006.01) |
| *A63B 23/04* | (2006.01) |
| *A63B 23/12* | (2006.01) |

(52) U.S. Cl.

CPC ... *A61H2201/1635* (2013.01); *A61H 2201/164* (2013.01); *A61H 2201/1664* (2013.01); *A63B 21/0428* (2013.01); *A63B 2022/003* (2013.01); *A63B 2022/0033* (2013.01); *A63B 2022/0035* (2013.01); *A63B 2022/0038* (2013.01); *A63B 2022/0041* (2013.01); *A63B 2022/0079* (2013.01); *A63B 2208/0204* (2013.01); *A63B 2208/0214* (2013.01); *A63B 2208/0219* (2013.01); *A63B 2208/0238* (2013.01); *A63B 21/00178* (2013.01)

(56) References Cited

U.S. PATENT DOCUMENTS

| | | | | |
|---|---|---|---|---|
| 3,101,944 | A | 8/1963 | Cencig | |
| 3,363,335 | A | 1/1968 | Burhns et al. | |
| 3,460,272 | A | 8/1969 | Pellicore | |
| 3,559,986 | A * | 2/1971 | Ehrmantraut | 482/70 |
| 3,582,069 | A * | 6/1971 | Flick et al. | 482/70 |
| 3,584,871 | A | 6/1971 | Kelmon, Jr. | |
| 3,620,530 | A | 11/1971 | Cosby | |
| D225,342 | S | 12/1972 | Flick et al. | |
| D225,343 | S | 12/1972 | Flick et al. | |
| 4,512,571 | A * | 4/1985 | Hermelin | 482/70 |
| 4,679,786 | A * | 7/1987 | Rodgers | 482/70 |
| 4,709,918 | A * | 12/1987 | Grinblat | 482/70 |
| 5,224,909 | A * | 7/1993 | Hamilton | 482/70 |
| 5,429,567 | A * | 7/1995 | Gerschefske et al. | 482/70 |
| 5,690,590 | A * | 11/1997 | Lo | 482/70 |
| 5,899,838 | A | 5/1999 | Jacobs | |
| 6,368,254 | B1 | 4/2002 | Wall | |
| 6,416,448 | B1 * | 7/2002 | Hassler | 482/131 |
| 6,733,428 | B2 | 5/2004 | List | |
| 6,837,838 | B2 | 1/2005 | List | |
| 7,125,370 | B1 * | 10/2006 | Schaffner et al. | 482/142 |
| 7,294,100 | B2 | 11/2007 | Bull | |
| 7,387,596 | B2 | 6/2008 | Towley, III et al. | |
| D622,787 | S | 8/2010 | Masterson et al. | |
| D623,244 | S | 9/2010 | Hoffman | |
| 7,850,578 | B2 | 12/2010 | Balaker et al. | |
| 7,931,570 | B2 | 4/2011 | Hoffman | |
| 7,955,229 | B2 | 6/2011 | Graham | |
| 8,100,815 | B2 * | 1/2012 | Balaker et al. | 482/70 |
| 8,118,717 | B1 | 2/2012 | Lai | |
| 8,500,611 | B2 * | 8/2013 | Hoffman | 482/123 |
| 2001/0036885 | A1 * | 11/2001 | Castellot et al. | 482/79 |
| 2003/0216230 | A1 * | 11/2003 | Wang | 482/123 |
| 2004/0053752 | A1 * | 3/2004 | Yang | 482/70 |
| 2004/0266593 | A1 | 12/2004 | Schwendeman | |
| 2006/0128539 | A1 * | 6/2006 | Marquez | 482/123 |
| 2007/0135280 | A1 | 6/2007 | Hamer | |
| 2009/0098983 | A1 | 4/2009 | Hoffman | |
| 2010/0130337 | A1 | 5/2010 | Stewart | |
| 2010/0317496 | A1 | 12/2010 | Abranchess | |
| 2012/0065030 | A1 * | 3/2012 | Sandvig | 482/79 |
| 2012/0077653 | A1 * | 3/2012 | Dedov | 482/139 |
| 2012/0108405 | A1 * | 5/2012 | Milo | 482/142 |
| 2014/0011645 | A1 * | 1/2014 | Johnson et al. | 482/121 |
| 2014/0100089 | A1 * | 4/2014 | Kermath et al. | 482/133 |

FOREIGN PATENT DOCUMENTS

| | | |
|---|---|---|
| NL | 880067 | 10/1989 |
| WO | DE4229970 | 3/1994 |
| WO | WO 9405374 | 3/1994 |

OTHER PUBLICATIONS

International Search Report and Written Opinion dated Nov. 19, 2014, in PCT/US2014/049658.

* cited by examiner

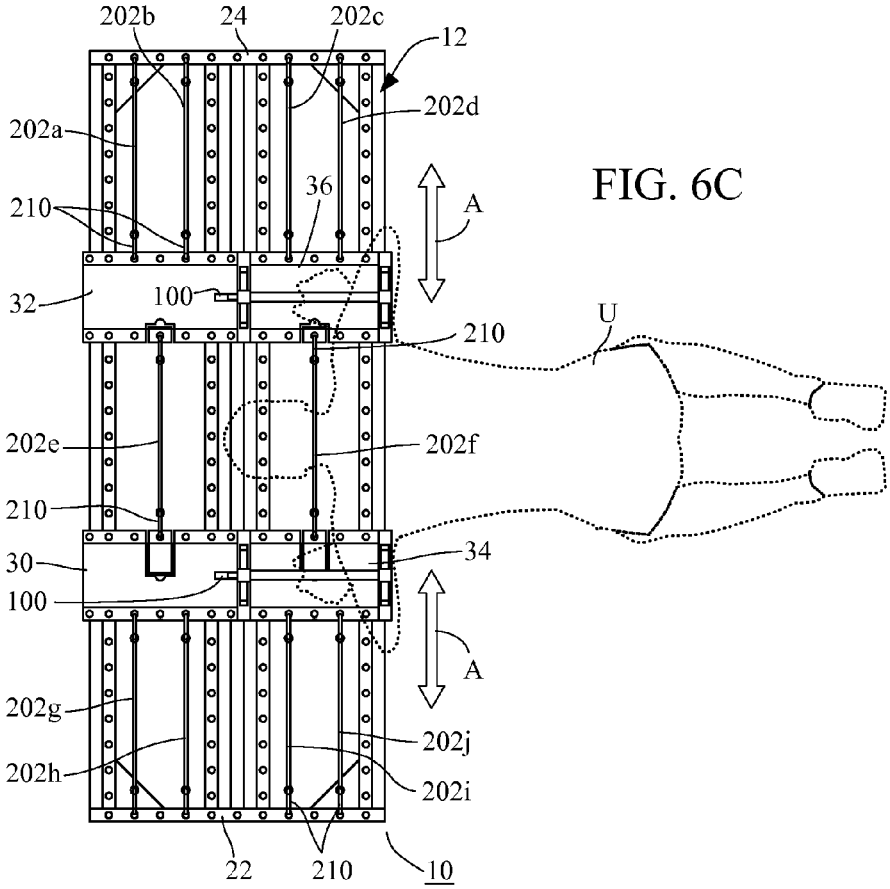
FIG. 6C
FIG. 6D
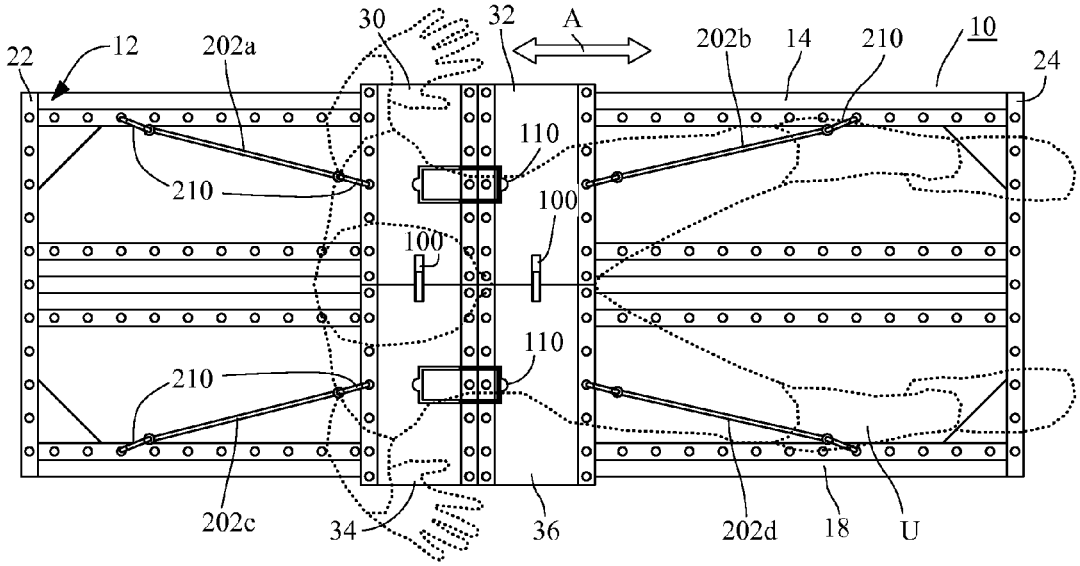

FIG. 10
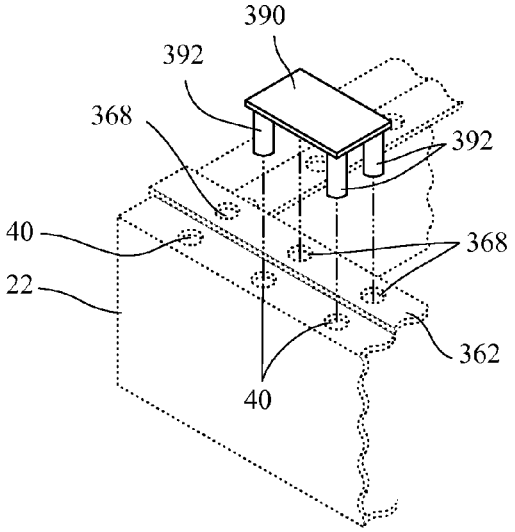
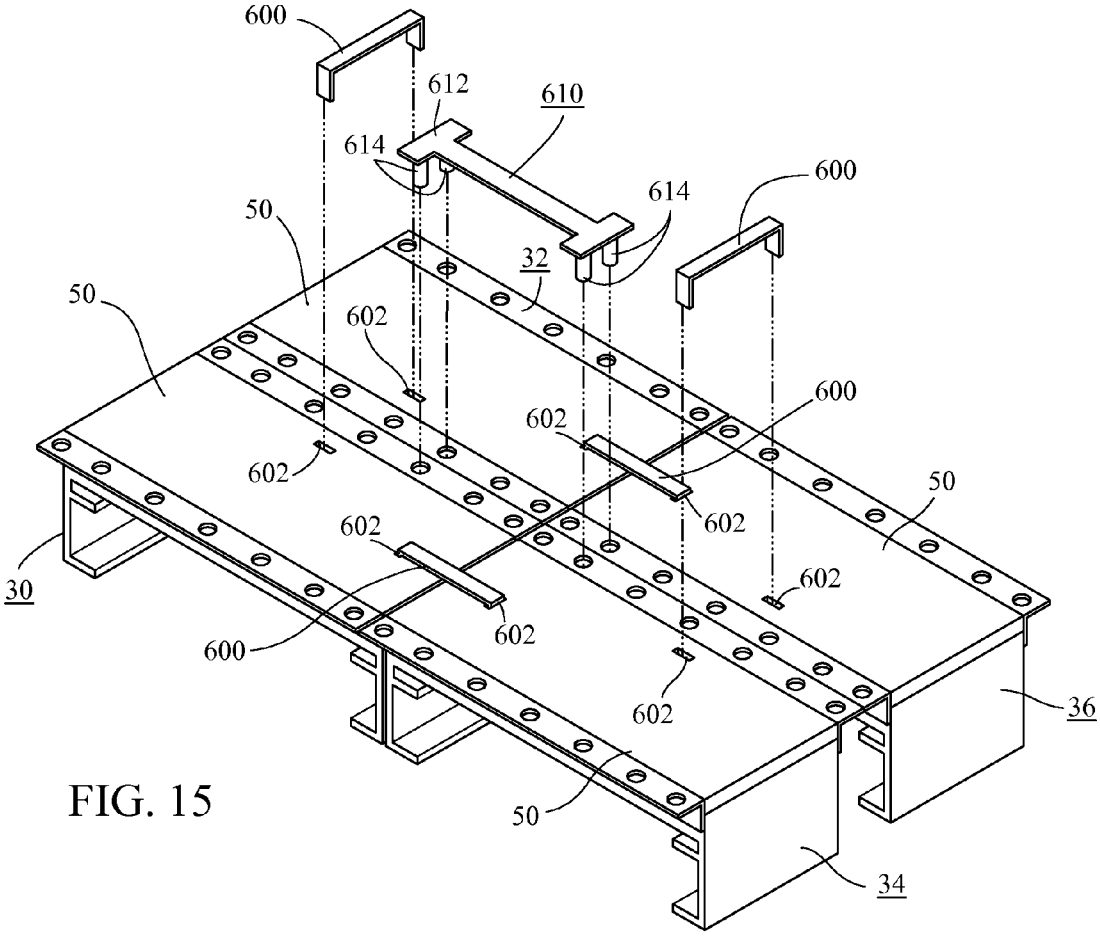
FIG. 15

THERAPEUTIC EXERCISE APPARATUS WITH MULTIPLE SELECTIVELY INTERLOCKABLE SLIDING PLATFORMS

BACKGROUND OF THE INVENTION

1. Field of the Invention

The present invention relates generally to a therapeutic exercise apparatus, and more particularly, to an exercise and rehabilitation apparatus with multiple platforms that are mounted for sliding movement and can be interlocked in various ways and used with interchangeable accessories to provide a variety of exercise/therapeutic modalities.

2. Description of Related Art

Exercise equipment can be used for both physical exercise and rehabilitation therapies. Activities to those ends can take many forms, such as aerobic exercise for toning and cardiovascular health, resistance training (movement against resistance) for increasing strength, and stretching for flexibility. Resistance training strengthens muscles through specific movements requiring particular muscles or muscle groups to move against a resistance. The necessary resistance can be provided by elastic bands, free weights or weight machines, and/or body weight. Callisthenic exercises such as push-ups and squats that use the body's own weight to provide resistance are by their nature limited for a variety of reasons, not the least of which is that the person's weight is both the minimum and the maximum available resistance to movement. Accordingly, many involved in strength training prefer to use separate weights or elastic bands. Aerobic exercise is often performed using machines such as treadmills, stationary bicycles, and other kinds of equipment, instead of running or cycling outside, for convenience or because of inclement weather.

Rehabilitation in the form of physical therapy is often required after many forms of surgery, illness, and traumatic injury. This can take the form of a combination of strength training, aerobic exercise, and stretching. In most cases, rehabilitation requires modalities that are adaptable to the specific movements required to perform the prescribed therapy, and must also be capable of adapting to improvements in the user's condition as the therapy proceeds. The versatility in exercise modalities necessary for effective physical therapy usually requires some sort of exercise apparatus, free weights, and/or elastic bands—in other words, some instrumentality besides a person's own body weight.

As noted, resistance training using weights other than one's body weight typically means free weights or machines designed to move a weight in a defined manner that concentrates on a particular group of muscles. For most people, this kind of weight training requires visiting a gym, since weight training machines or a complete set of free weights (barbells and dumbbells) can be very expensive and require a large space for storage. Likewise, machines designed for aerobic exercise are expensive and also require a lot of space. Thus, a trip to a gym is required for most people to use machines for aerobic exercise.

As a result, there have been many attempts to provide devices that can enable a user to perform one or more forms of exercise as conveniently as possible, usually in the home. Many of these devices are intended for easy transportation to enable exercise away from home, such as on business trips or vacations when the user cannot visit his or her regular exercise facility. Devices of this nature that have one or more sliding platforms are very popular, examples of one form or other of this kind of device being shown in the following patents and publications:

U.S. Pat. No. 3,559,986
U.S. Pat. No. 3,582,069
U.S. Pat. No. 3,620,530
U.S. Pat. No. 4,679,786
U.S. Pat. No. 5,690,590
U.S. Pat. No. 6,368,254
U.S. Pat. No. 6,837,838
U.S. Pat. No. 7,294,100
U.S. Pat. No. 7,850,578
U.S. Pat. No. 7,931,570
U.S. Pat. No. 7,955,229
U.S. Pat. No. D225,342
U.S. Pat. No. D225,343
U.S. Pat. No. D622,787
U.S. Pat. No. D623,244
Pub. No. US 2003/0216230
Pub. No. US 2007/0135280
Pub. No. US 2009/0098983
WO 1994/05374
JP 61-05930
JP 3145983 U

Many of these devices seek versatility in use. One example is shown in U.S. Pat. No. 3,559,986. It uses a pair of separate frames, each having a track on which a sliding platform can be removably mounted. For one type of exercise modality both platforms are placed on the track of a single frame for movement closer and farther apart. For a second type of exercise modality the frames are positioned side by side with a platform on each, so that the platforms move parallel to each other. While this permits two kinds of exercising motion, it is cumbersome because it uses two separate frames that have to be repositioned for different exercises and the platforms must be moved from frame to frame depending on the exercise the user wishes to perform.

There are also devices that have frames with tracks having platforms that slide to and fro on the tracks. Examples of this type of device are shown in U.S. Pat. No. 4,679,786 and No. 7,850,578. Taking the '786 patent first, it discloses an exercise device with four platform slides mounted on four side-by-side tracks. The platforms can move independently, but there are a limited number of exercises that can be performed by four slides that can only move parallel to each other. An alternate embodiment replaces the two center slides with a single slide essentially spanning two tracks, which does not result in much more versatility. Moreover, the patent appears to intend this alternative construction to be a completely different device, not a reconfiguration capable of being performed by the user. The '578 patent discloses an exercise device with two side-by-side tracks. In one embodiment it has a platform slide mounted on each track and a single platform slide mounted across both tracks. This configuration actually provides little added versatility since the available exercise modalities are defined largely by the limited configurations of the device, resulting in limiting the user's exercise regimen to those exercises for which the device is specifically designed.

Another category of device disclosed in the above listed patents is intended for only one type of exercise. An example is the stationary crawler disclosed in U.S. Pat. No. 3,582,069. This device has two sets of rails fixed side by side in a frame and two sliding platforms on each set of rails. The platforms can move relative to each other only in a predetermined fashion meant to simulate crawling on hands and knees as a form of physical therapy. That is, the user places his hands on the two front platforms and his knees on the two rear platforms, and a linkage system forces the two platforms on one set of rails to move toward each other as the two platforms on the other set of rails simultaneously move apart as if the user were crawling. No other type of exercise can be performed on this device.

What is missing from any known prior art is an apparatus that permits a user to reconfigure the apparatus quickly and easily so that it can be used to perform a multitude of exercise modalities, including physical therapy exercises. Those working in the art have previously recognized that multiple sliding platforms enable performance of a wide range of exercises, but the full versatility of this type of exercise apparatus has yet to be realized.

SUMMARY OF THE INVENTION

It is an object of the present invention to provide an apparatus that comprises multiple sliding platforms and that can be quickly and easily reconfigured by a user to provide a multitude of different exercise/therapeutic modalities.

In one preferred embodiment the therapeutic apparatus includes four platforms mounted for independent sliding movement on two adjacent tracks, with two platforms on each track, wherein a user can releasably interlock a platform on one track with the platform on the same track and/or with a platform on an adjacent track. The mechanism for interlocking the platforms can assume any construction suitable for the purposes discussed in more detail in the detailed description that follows further below. In a more generic form, the therapeutic apparatus comprises at least three platforms, wherein at least one platform is mounted on a first track and at least two platforms are mounted on a second track for independent movement adjacent to the platform mounted on the first track, and the interlocking mechanism includes a transverse interlock for connecting the platform on the first track to a platform on the second track for movement together and a longitudinal interlock for connecting the platforms on the same track for movement together.

In accordance with another aspect of the invention, the apparatus includes various removable and interchangeable accessories, such as elastic bands or springs, pulleys, handles that mount on the platforms, adapters for using the feet, weights that slide on the tracks and connect to the platforms, and appliances for permitting a user to passively move a joint, all of which can be used separately or in different combinations to provide myriad different exercise/therapeutic modalities.

In one embodiment of the disclosed apparatus the interlocking mechanism comprises a sliding interlock for adjacent platforms on different tracks and a hinged interlock for platforms on the same track. In an alternate interlocking mechanism according to the invention adjacent platforms are interlocked by removable clasps.

In another variation the apparatus includes a braking mechanism for resisting movement of the platforms along the tracks. The braking mechanism can be adjusted by the user to vary the resistance to movement of the platforms, thus providing additional versatility in the use of the apparatus.

Another aspect of the invention resides in the methods of configuring the apparatus by adding accessories and/or appliances and using the apparatus to perform various exercises and therapies.

Another aspect of the invention resides in a method of providing physical therapy to a knee joint using an exercise apparatus comprising a frame with two tracks, each including a pair of rails parallel to each other and to the rails of the other track, and cross braces connecting the rails at respective ends of the frame, and first and second platforms mounted for sliding movement on respective tracks. More specifically, the method comprises connecting the platforms for movement of one platform along the track on which it is mounted in response to movement of the other platform along the track on which it is mounted, providing a therapeutic appliance with a knee pad connected by a linkage to first and second base members for movement of the knee pad in a vertical direction in response to relative movement of the base members in a horizontal direction, connecting the first base member to a cross brace and the second base member to a platform, and placing a knee joint over the pad and moving the other platform back and forth with a foot to flex and extend the knee joint.

This Summary is provided to introduce in a simplified form a selection of concepts relating to the subject matter described herein that are further described below in the Detailed Description of Preferred Embodiments. It is not intended necessarily to identify key or essential features of the invention, nor as an aid in determining the scope of the claimed subject matter.

BRIEF DESCRIPTION OF THE DRAWINGS

The objects of the invention are not limited by the description above, and all of the objects and advantages of the invention will be better understood from the detailed description of its preferred embodiments which follows below, when taken in conjunction with the accompanying drawings, in which like numerals and letters refer to like features throughout. The following is a brief identification of the drawing figures used in the accompanying detailed description.

FIG. 7 comprises FIGS. 7A and 7B, which are plan views of the apparatus in FIG. 1 with respective pulley systems installed between the platforms and the frame.

FIG. 10 is an exploded isometric view of a connector for securing the appliance shown in FIGS. 8 and 9 in place on the apparatus.

FIG. 15 is an exploded isometric view of alternate mechanisms for selectively interlocking the sliding platforms together.

One skilled in the art will readily understand that the drawings are not strictly to scale, but nevertheless will find them sufficient, when taken with the detailed descriptions of preferred embodiments that follow, to make and use the present invention.

DETAILED DESCRIPTION OF EXEMPLARY EMBODIMENTS

The detailed description that follows is intended to provide specific examples of particular embodiments illustrating various ways of implementing the claimed subject matter. It is written to take into account the level of knowledge of one of ordinary skill in the art to which the claimed subject matter pertains. Accordingly, certain details may be omitted as being unnecessary for enabling such a person to realize the embodiments described herein. It will also be understood that terms indicating direction or orientation, such as "lower," "upper," "top," etc., may be used to facilitate the description of these exemplary embodiments. The use of such terms does not imply that the claimed subject matter is limited to a particular orientation of the structure being described.

General Configuration and Construction of Apparatus

Figure 1:
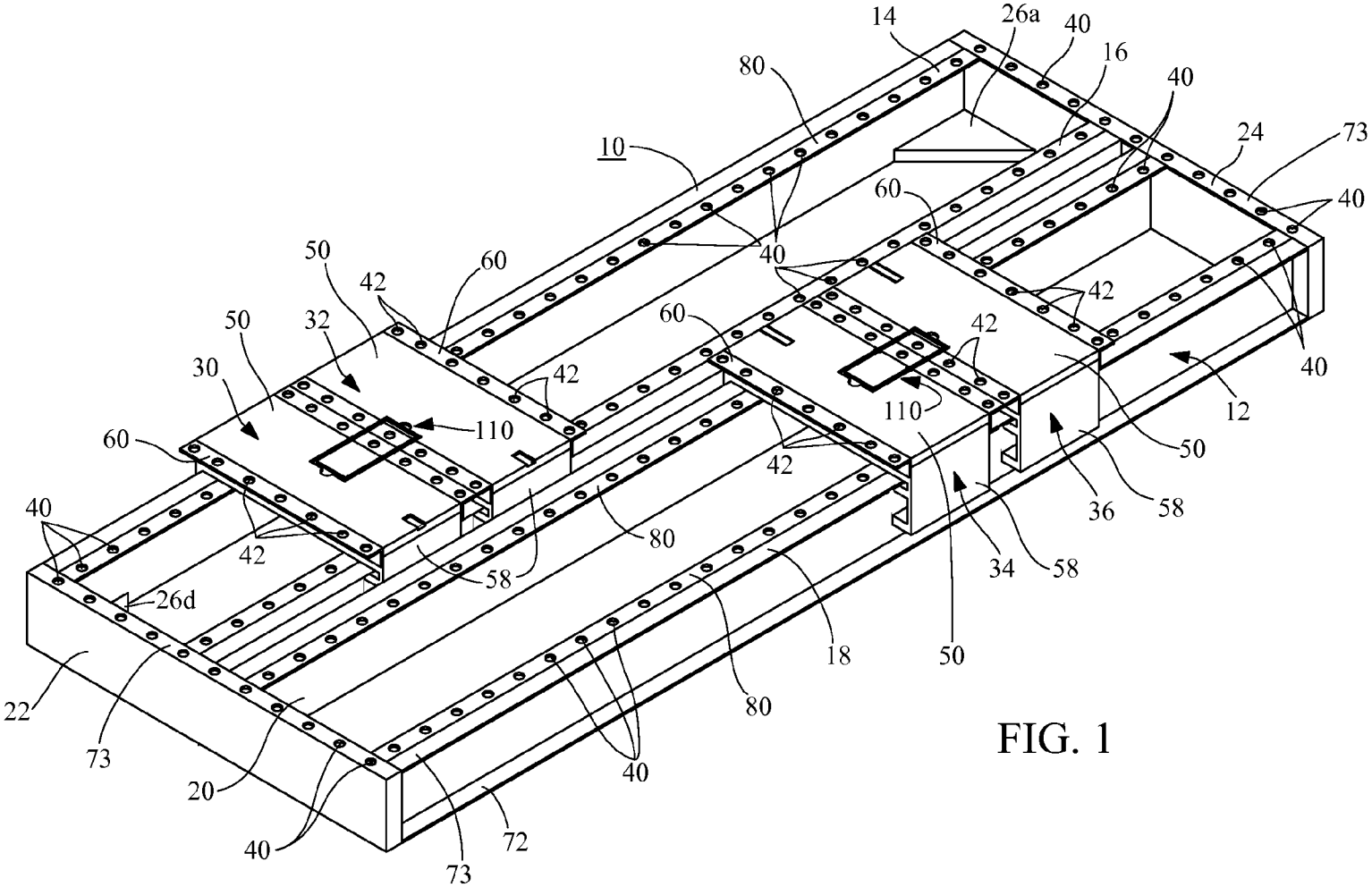
FIG. 1 is an isometric view of a therapeutic apparatus according to one embodiment of the invention, having four selectively interlockable platforms slidably mounted on two tracks, in a first configuration with the two longitudinally facing platforms on each track interlocked.
Figure 2:
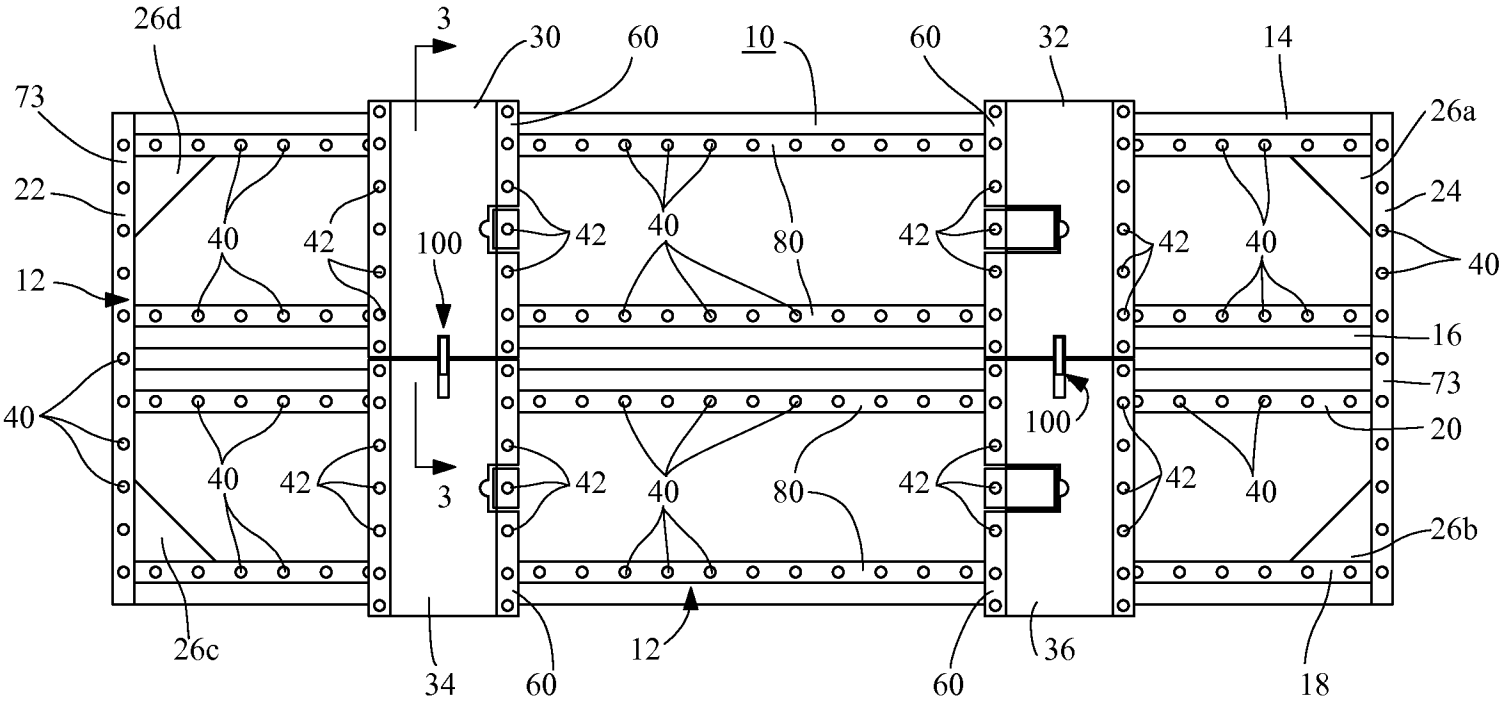
FIG. 2 is a plan view of the apparatus in FIG. 1, placed in a second configuration with two transversely facing platforms on adjacent tracks interlocked.
Figure 3:
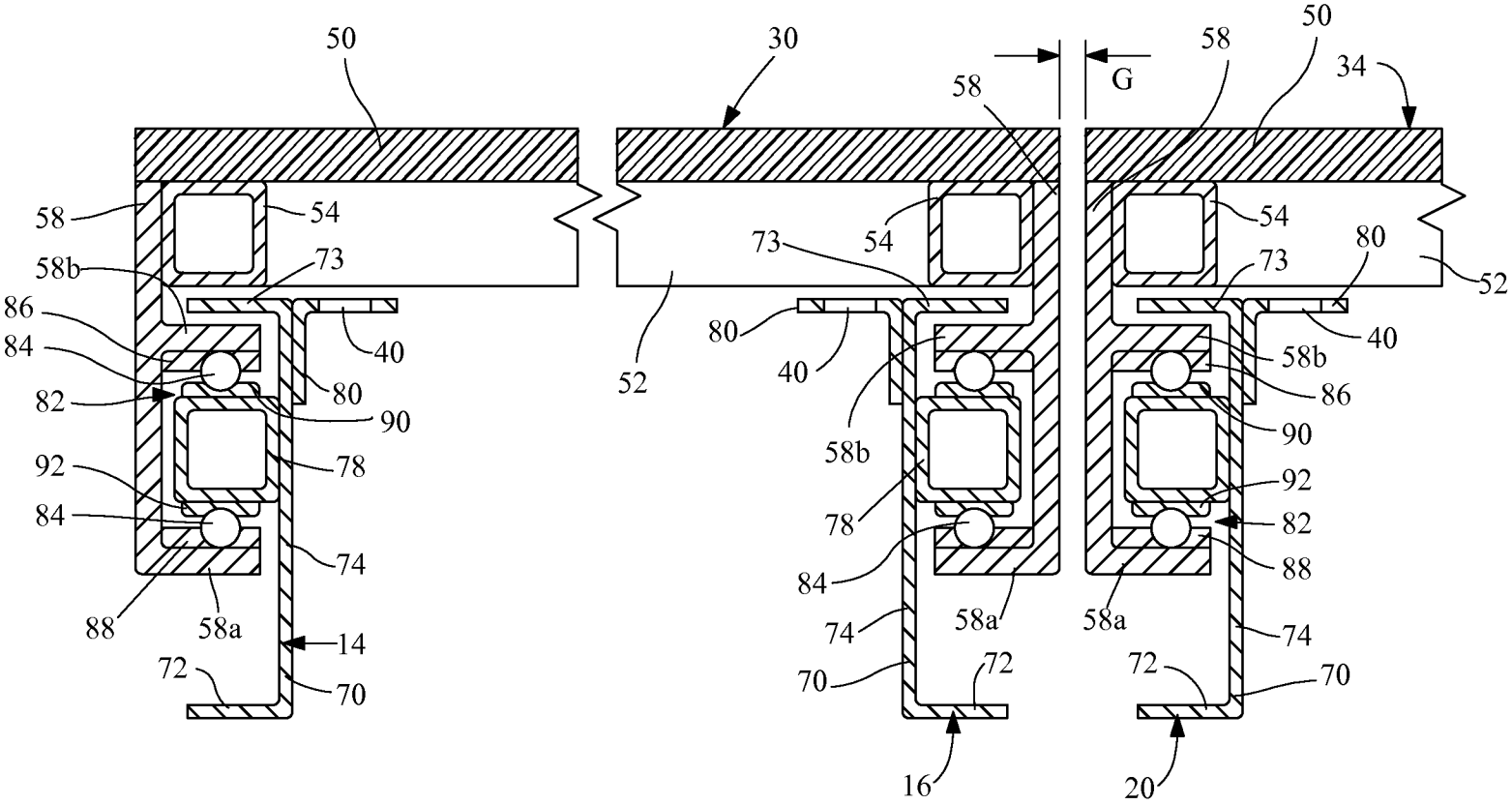
FIG. 3 is a detailed cross section taken along lines 3-3 in FIG. 2 to show constructional details of the platforms and of the rails comprising the tracks of the apparatus in FIG. 1, and a bearing arrangement mounting the platforms for sliding movement along the rails.

FIGS. 1 to 3 taken together illustrate the construction of an apparatus according to one embodiment of the claimed subject matter. FIG. 1 is an isometric view of a therapeutic exercise apparatus 10 according to one embodiment of the present invention. It includes a frame 12 that has a first track with a first pair of parallel rails comprising a first outer rail 14 and a first inner rail 16. A second track has a second pair of parallel rails comprising a second outer rail 18 and a second inner rail 20. The second pair of rails are parallel to the first pair rails 14 and 16. A first cross brace 22 connects one end of the rails and a second cross brace 24 connects the other end of the rails to form the rigid frame 12 having a rectangular platform. The rails and cross braces can be made of any suitable material that is sufficiently strong and rigid to serve the purposes of the apparatus as discussed herein. In an embodiment in which the apparatus is permanently assembled for use primarily in one place, they can be made of steel and welded together into a unitary structure. Corner braces 26*a*, 26*b*, 26*c*, and 26*d* can be welded in place to increase the strength, rigidity, and durability of the apparatus. In other embodiments the apparatus can be made of a lighter material such as aluminum, or even a suitable plastic resin material, with the rails and cross braces connected in a manner that permits easy assembly and disassembly by a user, such as by threaded fasteners. This type of construction would facilitate storage of the apparatus when not in use, thus further increasing its utility. Those skilled in the art of will be able readily to provide such a construction using conventional fabrication techniques.

The first pair of rails 14 and 16 mount a first platform 30 and a second platform 32 for sliding movement along the rails. The second set of rails 18 and 20 mount a corresponding third platform 34 and fourth platform 36 for sliding movement along those rails. The platforms are mounted on the respective rails so that they slide along the rails with minimum resistance to movement by a ball bearing arrangement shown schematically in FIG. 3 and discussed just below. The ball bearing arrangement and its mounting to the rails are omitted from FIG. 1 for clarity. As will be clear from the discussion in connection with FIG. 3, the platforms in the present embodiment are permanently mounted to the rails, but in an alternate embodiment, utilizing a frame that can be disassembled, the platforms could be removably mounted on the rails for portability and storage of the apparatus. Again, those skilled in the art will be readily capable of providing such a construction.

Figure 4:
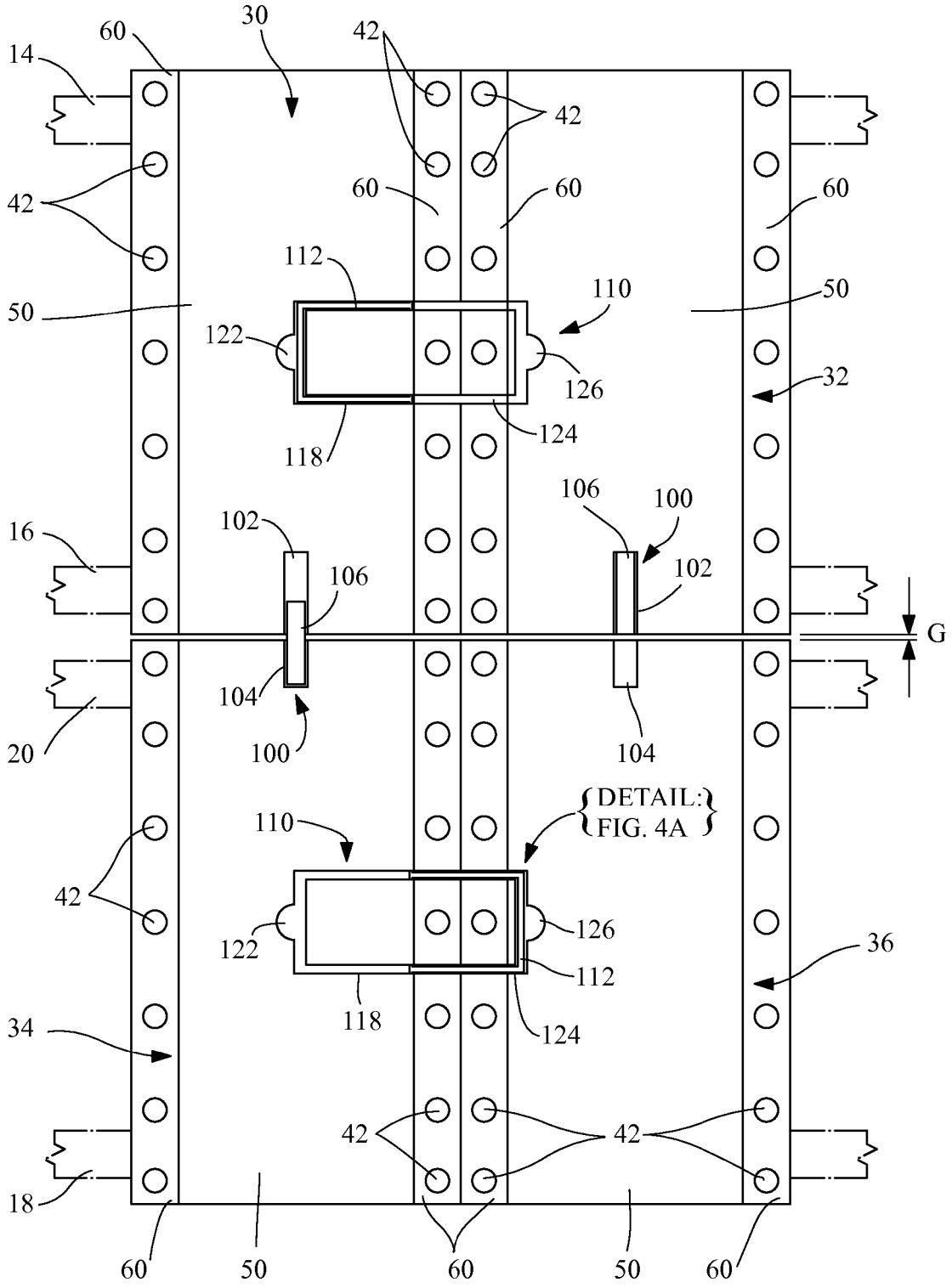
FIG. 4 is a plan view of the four platforms of the apparatus in FIG. 1 showing the details of the mechanism for selectively interlocking the platforms together.
Figure 4A:
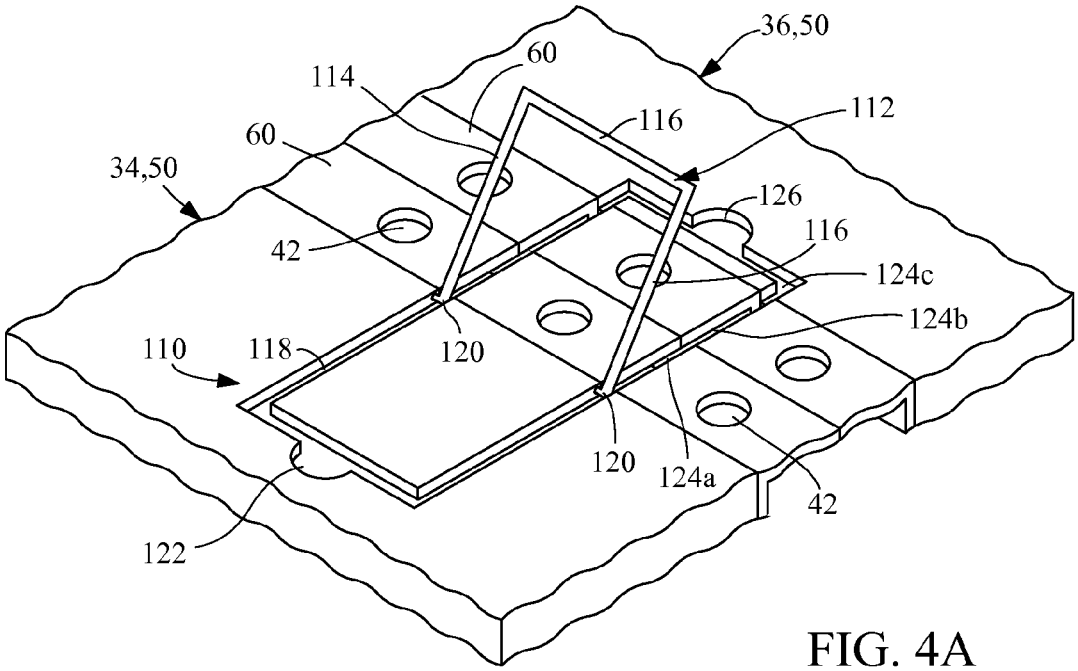
FIG. 4A is a detail of one aspect of the mechanism that interlocks platforms on the same pair of rails.

The platforms 30, 32, 34, and 36 are all mounted for movement independently of each other, but are selectively interlockable for movement together in various combinations by an interlocking mechanism shown in FIGS. 4 and 4A and discussed in detail further below. The platforms are rectangular in platform in the present embodiment, with their respective sides perpendicular and parallel to the rails so that sides of adjacent platforms mate with each other when they are in proximity. In FIG. 1 the apparatus 10 is in a first configuration with the two platforms 30, 32 and 34, 36 on the respective same pairs of rails 14, 16 and 18, 20 in proximity. In this configuration one side of the first platform 30 mates with an adjacent side of the second platform 32, and one side of the third platform 34 mates with an adjacent side of the fourth platform 36. FIG. 2 shows the apparatus 10 in a second configuration, with the two platforms 30, 34 and 32, 36 on respective different pairs of rails 14, 16 and 18, 20 in proximity. In this configuration one side of the first platform 30 mates with an adjacent side of the third platform 34, and one side of the second platform 32 mates with an adjacent side of the fourth platform 36. FIGS. 4 and 4A show how the sides of the platforms mate when they are adjacent, and how respective mating platforms can be selectively interlocked together. It will be appreciated that the construction of the platforms and the spacing between the inner rails 16 and 20 is designed to bring the adjacent sides of the platforms on different pairs of rails in close proximity, as shown in FIGS. 2 and 3. The rails 14, 16, 18 and 20, and the cross braces 22 and 24, have a series of small through-holes 40 along their lengths. The platforms 30, 32, 34, and 36 have small through-holes 42, preferably of the same diameter as the holes 40, along adjacent transverse sides of the platforms on the same pair of rails (that is, the platform sides extending transverse to the rails 14, 16, 18, and 20). The holes 40 and 42 provide connection points on the rails, cross braces, and platforms for connecting various accessories to the apparatus, as described further below. In a preferred embodiment, the holes 40 are uniformly spaced along the rails and cross braces and the holes 42 are uniformly spaced along the edges of the platforms, but other spacings of the holes 40 and 42 are within the scope of the invention.

Constructional details of the platforms 30, 32, 34, and 36 are largely optional as long as they permit the operation of the apparatus in accordance with the discussion herein. However, FIGS. 1 to 3 taken together show certain features that represent one possible platform construction. The platforms are preferably identical (except for the interlocking mechanism) for ease and economy of manufacture. In the example depicted here, certain parts are made of steel and connected together by welding, although other constructional materials, such as aluminum or a suitable plastic resin can be used, and connections can be made using adhesives and/or fasteners. FIG. 3, which is a cross section along the line 3-3 in FIG. 2, illustrates the construction of the platforms, the rails, and the ball bearing arrangement that slidably mounts the platforms to the rails. Each platform includes a main support plate 50 that spans the rails on which the platform is mounted and provides a surface for supporting a user during an exercise or therapy session. The support plate 50 in the present embodiment is made of a plastic resin for a number of reasons. First, it can be easily molded or machined with a surface contour such as knurling or scoring that increases friction to inhibit slippage of a user's hand or other body part during various exercise/therapy modalities that are possible with the apparatus. It also facilitates manufacture of the latching mechanism discussed below in connection with FIGS. 4 and 4A.

The support plate 50 is secured by countersunk screws (not shown) to a rigid undercarriage that includes two transverse steel box girders 52 (only one of which is shown for a given platform in FIG. 3) and two longitudinal box girders 54. The transverse girders and the longitudinal girders are welded together at their ends to form a box girder support assembly that presents a rectangular planar top surface. The undercarriage further includes depending support brackets 58 welded to the sides of each longitudinal girder 54. These support brackets are in the shape of an inverted "F," with the top edge of each bracket 58 (the end of the vertical leg of the "F") flush with the top surface of the rectangular plane formed by the box girder assembly. The periphery of the support surface thus formed by the transverse box girders 52 and the top edges of the support brackets 58 is coextensive with the outside periphery of the main support plate 50. This arrangement can also be seen in FIG. 1. A pair of inward facing bearing flanges 58*a* and 58*b* (the cross pieces of the "F") integrally formed as part of the support bracket 58 provide support for a ball bearing arrangement discussed in a moment. The bottom bearing flange 58*a* preferably forms the bottom end of the depending bracket 58 and the top bearing flange 58*b* is spaced from the bottom flange 58*a* a distance that will accommodate the ball bearing arrangement. Finishing each platform is an L-shaped platform connection flange member 60 (see FIGS. 1 and 2). A depending leg of the flange member 60 is welded to the outside surface of the transverse box girder 52 with the top surface of a horizontal leg of the flange flush with the top surface of the main support plate 50, as seen in FIG. 1, and the holes 42 are formed in the horizontal leg.

The rails 14, 16, 18, and 20 are also most conveniently made identical to each other with an exemplary construction such as that most clearly shown in FIG. 3. In this instance each rail includes a C-shaped channel girder 70 with a bottom leg 72 and a top leg 73 connected by an integral upright 74. The ends of the channel girders 70 are welded to the cross braces 22 and 24, which in a typical construction comprise channel girders generally identical in cross section to the channel girders 70. The channel girders 70 comprising the rails 14, 16, 18, and 20 and the cross braces 22 and 24 form the frame 12 as discussed above in connection with FIGS. 1 and 2, with the bottom legs 72 and the top legs 74 of the channel girders 70 lying in spaced apart planes. The bottom plane provides support for the entire apparatus, as seen in FIG. 1.

In the case of the rails 14, 16, 18, and 20, a bearing support box girder 78 is welded to the outward facing surface of the upright 74 of the C-shaped channel girder intermediate the legs 72 and 73. The girder 78 extends for substantially the entire longitudinal extent of each rail (that is, from end to the other as seen in FIG. 1, although the girder 78 itself is omitted from FIG. 1 for clarity). The box girder 78 is sized to accommodate the ball bearing arrangement discussed in the next paragraph. The box girder 78 is positioned vertically to permit the top leg 73 of the channel girder 70 to pass between the top bearing flange 58*b* of the associated support bracket 58 and the bottom surface of the associated longitudinal box girder 54. Finishing each rail is an L-shaped frame connection flange member 80 (see FIGS. 1 and 2). A depending leg of the flange member 80 is welded to the inside surface of the channel girder upright 74 with the top surface of a horizontal leg of the flange member 80 flush with the top surface of the top leg 73 of the channel girder 70. In the case of the cross braces 22 and 24, the top and bottom legs of the channel girder face inwardly and the holes 40 are formed in the top leg 73. The holes 40 are formed in the horizontal leg of the flange 80 (in the case of the rails) and in the top leg 73 of the girder (in the case of the cross braces) by any suitable manufacturing technique, such as drilling. It will be appreciated from the configuration of the rails and cross braces as shown in FIG. 3 that details depicting how the channel girders 70 comprising the rails and the cross braces are connected together to form the frame 12 have been largely omitted from FIG. 1 and other drawings for ease of illustration. Those skilled in the art will be capable of providing any necessary auxiliary parts such as corner brackets and so forth required to make the frame 12 a rigid structure in accordance with the various methods of using the apparatus 10 as described further below.

The ball bearing arrangement is depicted generally at 82 in FIG. 3. (It is omitted from FIG. 1 and other figures for clarity.) It will be appreciated that FIG. 3 depicts the bearing arrangement in schematic form to represent a more or less conventional ball bearing slide arrangement, and some details are omitted for ease of illustration. The principle of operation of such a bearing arrangement is nevertheless conventional insofar as it provides a sliding mounting that uses a plurality of spherical balls 84 retained in top and bottom linear races by a top ball retainer 86 and a bottom ball retainer 88. The ball retainers 86 and 88 are securely fastened to the facing surfaces of the top bearing flange 58*b* and the bottom bearing flange 58*a*, respectively, of each support bracket 58. The retainers extend for a substantial length in the longitudinal direction of the platform and the support bracket (that is, normal to the plane of FIG. 3), to provide a sufficient number of balls 84 to support the forces exerted on the bearing during the various exercise/therapy modalities that the apparatus is capable of accommodating. The balls 84 bear against the inside surfaces of the retainers 86 and 88, which are made of hardened steel, and against hardened steel bearing strips 90 and 92 securely fastened to the top and bottom, respectively, of the bearing support box girders 78 and extending the length thereof. The balls 84 fit in grooves along the faces of the bearing strips 90 and 92 to prevent movement of the platform relative to the rails in a direction transverse to the sliding direction of travel of the platform on the rails. This maintains the proper positioning of the platforms in the transverse direction to provide a small predetermined gap G between transversely facing platforms. This ensures that the platforms on one tracks can move freely past each other without interference from the platforms on the adjacent track.

FIGS. 4 and 4A show an interlocking mechanism in accordance with the present embodiment of the apparatus 10. Taking FIG. 4 first, a transverse interlock 100 is movable between a locked position where it prevents relative movement of transversely facing platforms and an unlocked position in which the transverse platforms on adjacent rails can freely move relative to each other. The rails 14, 16, 18, and 20 are shown in phantom dot-dash lines to orient the viewer. There are two transverse interlocks, which for ease of construction are identical, located at the longitudinal edges of the platforms (that is, the edges extending in the direction of the rails). Each transverse interlock includes recesses 102 in the surfaces of the main support plates 50 of the platforms 30 and 34 that open into their respective inner longitudinal platform edges. Similar recesses 104 in the surfaces of the main support plates 50 of the platforms 32 and 36 open into their respective inner longitudinal platform edges. A locking slider 106 is captured in each of the recesses 102 and 104 in a suitable fashion (not shown) that allows the slider to move freely in the grooves 102 and 104. This can be a tongue-in-groove arrangement with a tongue on each wall of the slots or the slider and a cooperating groove in the facing wall of the slider or slot, respectively (not shown). In an alternate arrangement, the each slot could have undercut portions (not shown) extending the length of the slot at the bottom of each opposing slot wall to form an internal shoulder that captures a flange (not shown) formed along the bottom of each side wall of the associated slider.

The slots 102 are approximately the same length as or slightly longer than the slider 106, so that when the sliders are fully within the slots 102, in their unlocked position, the platforms 30, 34 can move freely relative to the facing transverse platforms 32, 36. A detent mechanism (not shown) retains each slider in this unlocked position, shown between platforms 32 and 36 in FIG. 4. The slots 104, however, are shorter than the sliders 106, so that when the end of the slider meets the blind end of its associated slot 104, a portion of the slider remains in the slot 102 in a facing transverse platform. In this locked position the slider 106 prevents relative movement along the rails of the interlocked transversely facing platforms 30, 34 and 32, 36. A suitable detent mechanism (not shown) retains each slider in this locked position, shown between platforms 30 and 34 in FIG. 4. Detents can be formed by small protrusions in the edges of the slots or sliders that fit into cooperating recesses in the edges of the associated slider or slot. Fabrication of the slots 102 and 104 is facilitated by making the platforms' main support plates 50 of a plastic resin, which can be molded with the necessary configuration for capturing the sliders in the slots and the detent mechanism for maintaining the sliders selectively and individually in either of their locked or unlocked positions. The sliders 104 and 106 can optionally be provided with small posts (not shown) on their top surfaces to facilitate moving the sliders in the slots.

A longitudinal interlock 110 is movable between a locked position where it prevents relative movement of longitudinally facing platforms and an unlocked position in which the platforms on the same rails can freely move relative to each other. FIG. 4A illustrates further details of the locking mechanism 110 for interlocking the platforms 34 and 36, but the other longitudinal interlock 110 between the platforms 30 and 32 is identical. The interlock 110 includes a U-shaped latch 112 with two legs 114 and a connecting leg 116. A groove 118 in the surface of the main support plate 50 of the platform 34 has a shape that matches the shape of the U-shaped latch 112. The groove 118 extends to and opens into the transverse edge of the support plate 50, and the ends of the legs 114 of the latch 112 are connected at respective hinges 120 in the groove 118 at the edge of the support plate. The hinges can be formed in any suitable fashion, but most conveniently they comprise small protrusions (not shown) on the sides of the legs that fit into cooperating depressions (not shown) in the walls of the grooves. For strength and durability the latch 112 is preferably made of metal such as steel or aluminum. The shape and size of the groove 118 exactly matches the shape of the U-shaped latch 112 so that the latch stows in the groove 118 substantially flush with or slightly below the top surface of the support plate 50. A small finger cutout 122 incorporated into the groove 118 permits a user to easily lift the stowed latch out of the groove 118 to rotate about the hinge 120. When the latch 112 is in the groove 118, it is in the unlocked position and permits the platforms 34 and 36 to freely move longitudinally apart. In FIG. 4 the latch is in the unlocked position between platforms 30 and 32.

Referring still to FIG. 4A, adjacent platforms are interlocked to prevent them from separating in the longitudinal direction (along the rails) by rotating the latch 112 about the hinge so that it enters a groove 124 (see FIG. 4) that has a portion 124*a* through the horizontal leg of the flange 60 at the edge of the main support plate 50 of the platform 34, a portion 124*b* through the horizontal leg of the flange 60 at the edge of the main support plate 50 of the platform 36, and a portion 124*c* formed in the surface of the main support plate 50 of the platform 36. The shape and size of the groove 124 also exactly matches the shape of the U-shaped latch 112 so that the latch stows in the groove 124 substantially flush with or slightly below the top surfaces of the two legs of the flanges 60 and of the support plate 50 of the platform 36. A small finger cutout 126 incorporated into the groove portion 124*c* permits a user to easily lift the stowed latch out of the groove 124 to rotate about the hinge 120. When the latch 112 is in the groove 124, it is in the locked position and prevents the platforms 34 and 36 from separating in the longitudinal direction. In FIG. 4 the latch is in the locked position between platforms 34 and 36.

The exercise/therapy apparatus 10 is thus capable of selective interconnection of multiple independently movable platforms on separate tracks by an interlocking mechanism that includes a transverse interlock and a longitudinal interlock. A user can move both interlocks between a locked position and an unlocked position. The transverse interlock prevents relative movement of transversely facing platforms (on different tracks) when in a locked position, while in an unlocked position a particular platform is not tied to another platform on the other track. The longitudinal interlock allows a user selectively to connect platforms on the same track together, and to permit platforms on the same track to move independently of each other. Using this arrangement with various interchangeable accessories and appliances to be described now provides a heretofore unknown degree of versatility to any exercise or therapy regimen.

In a more generic form of the invention more than two platforms can be mounted on a single track. In still another form, one of the tracks can mount a single platform, which can interlock with any of multiple platforms on the other track. Those skilled in the art will appreciate that the ability to have different numbers of platforms that can be interlocked in a variety to ways to use accessories and appliances like those described below is a major contribution to the versatility of the present invention.

Implementing Exemplary Exercise/Therapy Modalities Using the Apparatus

The versatility of the apparatus described above will be more apparent from the following examples of various accessories and appliances that can be used with the apparatus having the platforms interlocked in different configurations. It will be appreciated that the accessories and appliances specifically depicted and described herein are not exhaustive of all accessories that can be used in conjunction with the basic apparatus just described. Rather, they are intended to represent just some of the ways the apparatus can be used. What will be clear as the following description proceeds is the unprecedented versatility of an apparatus embodying principles of the present invention.

Elastic Resistance Members.

Figure 5:
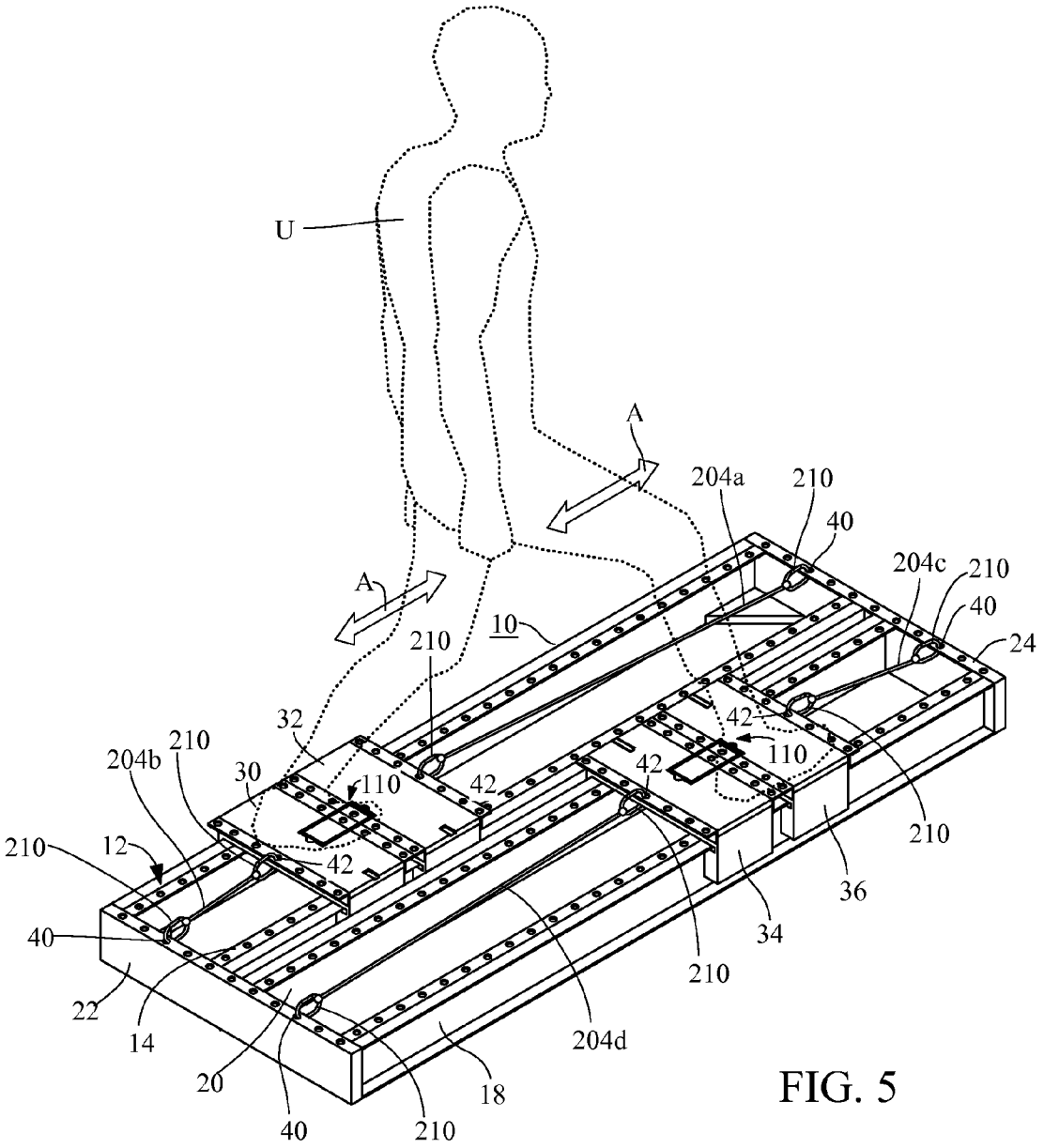
FIG. 5 is an isometric view of the apparatus in FIG. 1 with elastic resistance bands deployed between the platforms in accordance with one possible configuration to provide resistance to movement of one or more of the platforms; the figure also illustrates one type of exercise that can be performed with the apparatus in this configuration.

With reference first to FIG. 5, an exercise apparatus 10 as shown in FIG. 1 is configured with the two pairs of longitudinally facing platforms 30, 32 and 34, 36 interlocked using their respective longitudinal interlocks 110. Elastic resistance members in this embodiment comprise elastic bands in three different free lengths (that is, when they are not under tension), namely a short elastic band 202, an intermediate length elastic band 204; and a long elastic band 206. In the FIG. 5 embodiment a first intermediate length elastic band 204*a* is connected between the platform 32 and the second cross brace 24, and a second intermediate length elastic band 204*b* is connected between the platform 30 and the first cross brace 22. A third intermediate length elastic band 204*c* is connected between the platform 36 and the second cross brace 24, and a fourth intermediate length elastic band 204*d* is connected between the platform 34 and the first cross brace 22. In a preferred embodiment there are a limited number of different elastic bands to simplify use of the apparatus. The bands may be depicted in different lengths in the figures because they have been stretched for mounting or in use in accordance with the configuration being described. This is the case in FIG. 5 in which the exercise being performed (described further below) has resulted in lengthening of the bands 204*a* and 204*d* and shortening of the bands 204*b* and 204*c*.

A releasable clip 210 attached to each end of the elastic bands secures the end of the band to a platform, a rail, or a cross brace. Each clip 210 comprises an elongated ring with a hinged, spring-loaded latch that permits it to snap into any desired through-hole 40 or 42 in the rails, cross braces or platforms to position the elastic band in accordance with the preference of the user. The clips are most conveniently carabiner-type clips familiar to users of exercise equipment, and permit the elastic bands to be removably attached to the platforms and cross braces (and to the rails in other configurations described below). Most preferably, the clips 210 are permanently attached to the ends of the elastic bands to increase the convenience to the user by permitting the end of an elastic band with its associated clip to be connected to the apparatus in a single operation, rather than needing also to be attached separately to the elastic band. It will also reduce the number of different parts that have to be accounted for in using the apparatus. It will be appreciated that the through-holes are only meant to illustrate one way of providing connection points for selectively connecting an accessory such as the elastic bands or other appliance between the frame and a platform. Other connection points, such as individual eyes that accept hooks on the ends of the elastic bands can be also be employed within the scope of the invention.

The elastic resistance members according to the present embodiment are constructed like conventional resistance-training elastic bands. However, they can be of any form, such as an elongated tension spring, that provides resistance to movement resulting from stretching the resistance member. A suitable elastic band can be constructed in the same fashion as Thera-Band® exercise bands available commercially from The Hygenic Corporation of Akron, Ohio. Elastic bands of a given free length can also be made to provide different amounts of resistance to movement (that is, by incorporating a different spring constant), which will further increase the versatility of the apparatus. The elastic resistance members can further incorporate any suitable form of visual indicia that enables the user to determine at a glance the properties of a given member (such as its length and/or amount of resistance to stretching), to provide increased convenience. An example of such indicia would be regions of different colors on the bands to indicate salient properties such as length and strength of resistance to movement. This feature of the invention will make it even more convenient for the user to set up the apparatus in the desired configuration for any particular exercise.

An example of an exercise that can be formed by the apparatus as set up in FIG. 5 is illustrated by a user U depicted in phantom lines in the figure. In this exercise the user can place one foot on each of the interlocked longitudinal platform pairs 30, 32 and 34,36 and move each leg back and forth as shown by the arrows A to stride as if walking. This exercise enables the apparatus to be used in a fashion resembling a treadmill, elliptical trainer, or cross country ski machine. In other words, the benefits of those much larger and more expensive pieces of equipment can be achieved with a much smaller and less expensive apparatus according to the present invention.

Figure 6A:
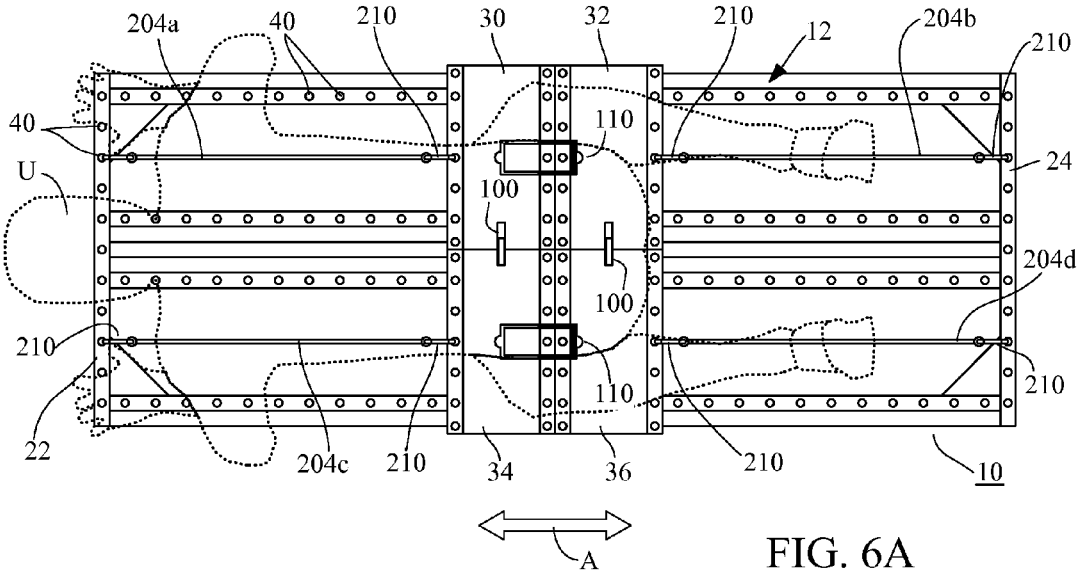
FIG. 6 comprises FIGS. 6A, 6B, 6C, 6D and 6E, which are plan views of the apparatus in FIG. 1 with other exemplary deployments of elastic resistance bands between the platforms interconnected in various configurations; each figure also illustrates one type of exercise that can be performed with the apparatus in the illustrated configuration.

FIGS. 6A to 6E illustrate the apparatus in various configurations using different numbers and kinds of elastic bands connected in various fashions to show just a few of the exercises that are possible with the present invention in forms such as those described thus far. It will be appreciated that it is the ability to interlock the platforms 30, 32, 34 and 36 in various ways, and use resistance members connectable in virtually limitless combinations, that imparts this versatility to the apparatus. FIG. 6A is used in a configuration in which all four platforms 30, 32, 34 and 36 are interlocked using their respective transverse interlocks 100 and longitudinal interlocks 110. A first intermediate-length elastic band 204*a* is connected between the platform 30 and the first cross brace 22 using the releasable clips 210 permanently attached to the ends of the band 204*a*. A second intermediate-length elastic band 204*b* is connected in the same way between the platform 32 and the second cross brace 24. The platforms 34 and 36 are similarly connected to the cross braces 22 and 24, respectively, using a third intermediate-length elastic band 204*c* and a fourth intermediate-length elastic band 204*d*. FIG. 6A shows the apparatus in this configuration with the knees of the user U on the interlocked platforms and his or her hands on the frame 12. The frame can include removable hand rests (not shown) that have small studs that fit within the holes 40 in the frame to hold them in place. In this exercise the user U can move his or her knees back and forth in the direction of the arrow A against the resistance of the elastic bands 204 to strengthen the abdominal muscles.

Figure 6B:
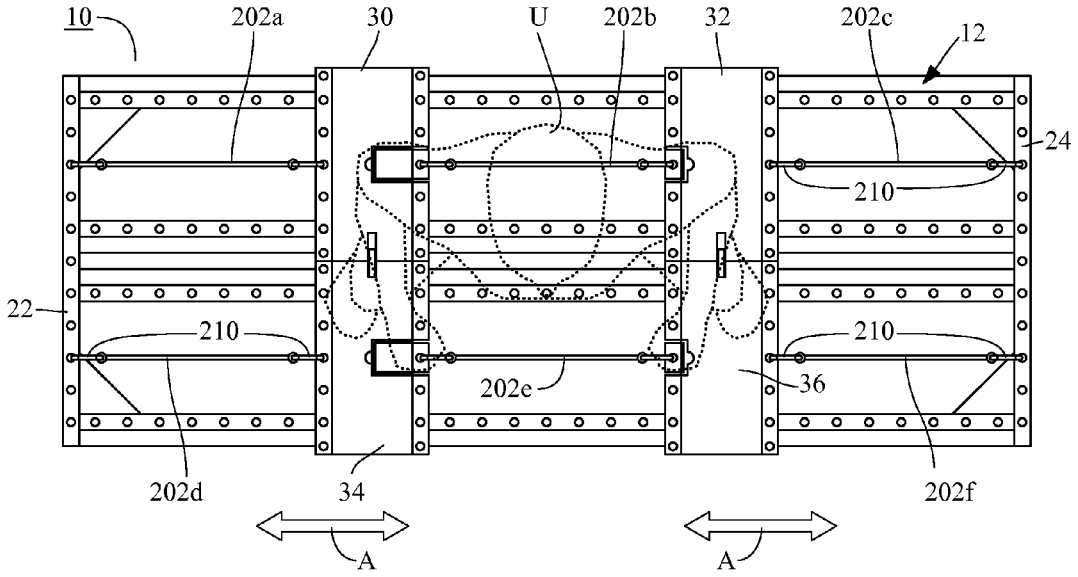

FIG. 6B illustrates the apparatus 10 in a configuration in which the two transversely facing platforms 30, 34 and the two transversely facing platforms 32, 36 are interlocked using their respective transverse interlocks 100. The first short elastic band 202*a* is connected between the platform 30 and the first cross brace 22. The second short elastic band 202*b* is connected between the platforms 30 and 32. A third short elastic band 202*c* is connected between the platform 32 and the second cross brace 24. The platforms 34 and 36 are similarly connected to each other and to the cross braces 22 and 24 using fourth, fifth and sixth short elastic bands 202*d*, 202*e* and 202*f*, as shown in FIG. 6B. In the exemplary exercise depicted in this figure the user U stands with each foot on one of the interlocked pairs of platforms and moves the interlocked platforms apart and together in the directions of arrows A against the resistance of the bands 202.

FIG. 6C illustrates the apparatus in a configuration in which the platforms 30, 32, 34, and 36 are interlocked as in FIG. 6B, but having additional short elastic bands between the respective interlocked transversely facing platforms 30, 34 and 32, 36. This configuration uses 10 short elastic bands 202*a* to 202*j*, connected as depicted in the figure. It is shown with a user U kneeling at the side of the apparatus with a hand on each pair of interlocked platforms 30, 34 and 32, 36. Moving the hands back and forth in the direction of the arrows A exercises the user's pectoral muscles in a fashion similar to a dumbbell fly exercise. FIG. 6C shows the apparatus with handgrips such as those described in connection with FIG. 11. This provides the user with a more positive grip on the platforms and is particularly useful when using elastic bands having a high resistance to elongation.

FIG. 6D illustrates the apparatus 10 in a configuration in which all four platforms 30, 32, 34 and 36 are interlocked using their respective transverse interlocks 100 and longitudinal interlocks 110. The first short elastic band 202*a* is connected between the platform 30 and a selected through-hole 40 in the side rail 14. The second short elastic band 202*b* is connected between the platform 32 and a selected through-hole 40 in the side rail 14. The platforms 34 and 36 are similarly connected to the side rail 18 by the third and fourth short elastic bands 202*c* and 202*d*, as shown in FIG. 6D. This configuration illustrates another feature of the apparatus that provides even more versatility. Providing a way of connecting the elastic bands to the side rails instead of the cross braces 22 and 24 reduces the total number of elastic bands with different resistances required to enable the apparatus to adapt to use with different users. That is, the configuration in FIG. 6D can use short elastic bands between the side rails and platforms instead of intermediate-length elastic bands connected between the cross braces and the platforms. FIG. 6D shows the user U sitting on the interlocked platforms and performing a leg exercise in which his or her feet push against cross brace 24 to move the platforms back and forth in the direction of the arrow A.

Figure 6E:
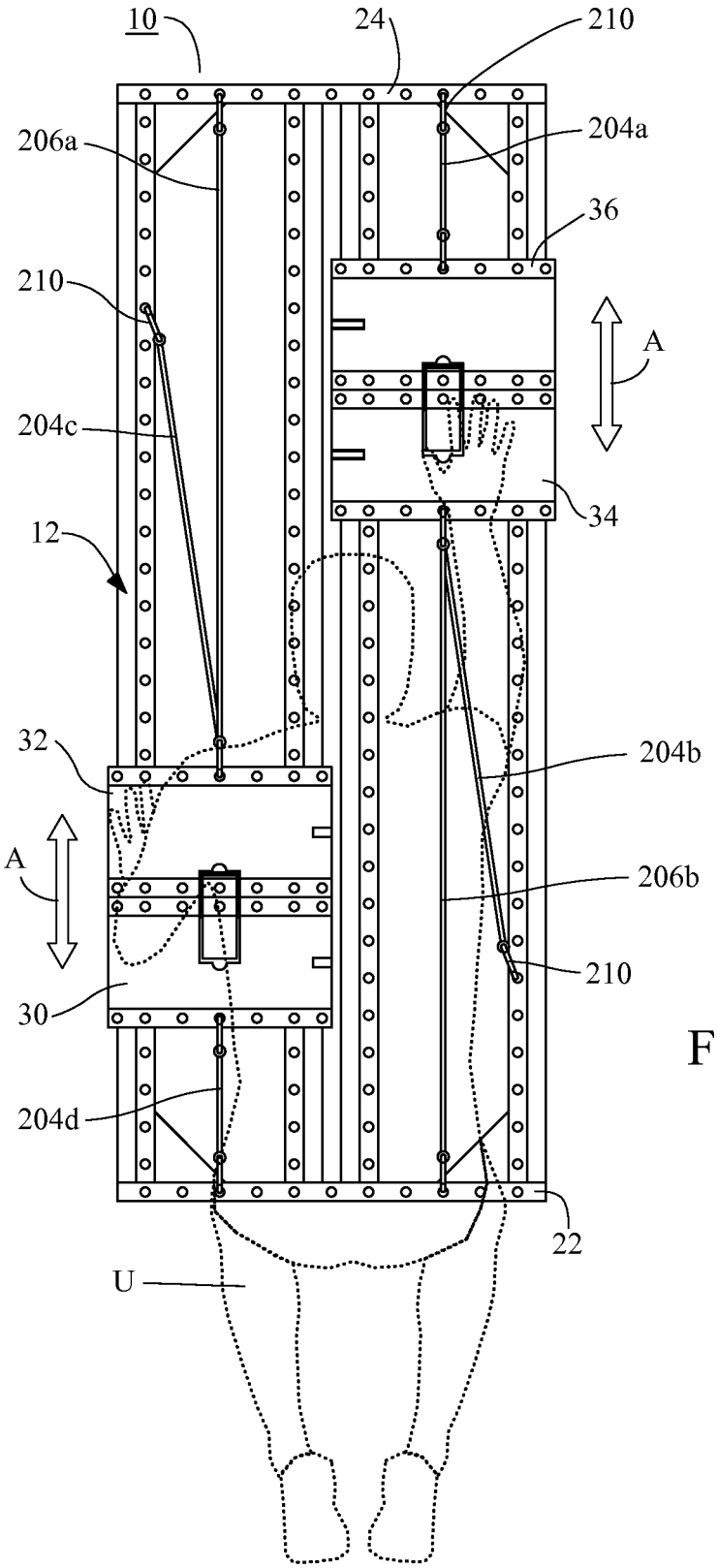

FIG. 6E illustrates the exercise apparatus 10 in a configuration similar to that in FIG. 5, with the two pairs of longitudinally facing platforms 30, 32 and 34, 36 interlocked using their respective longitudinal interlocks 110. This configuration further illustrates the versatility of the apparatus in providing ways of adjusting the resistance to movement for individual users. In this exercise the user U has each hand on a pair of interlocked platforms as depicted in the figure and moves the platforms in the direction of the arrows A against the resistance provided by the elastic bands, It will be appreciated that the configurations shown in FIGS. 5 and 6, in which the platforms are interlocked in various combinations and connected with elastic resistance members in a variety of configurations, are only a small sample of the countless possible configurations that the apparatus can assume to enable a user to perform a variety of exercises against resistance. All such configurations and combinations are within the scope of the present invention.

Pulleys.

Figure 7A:
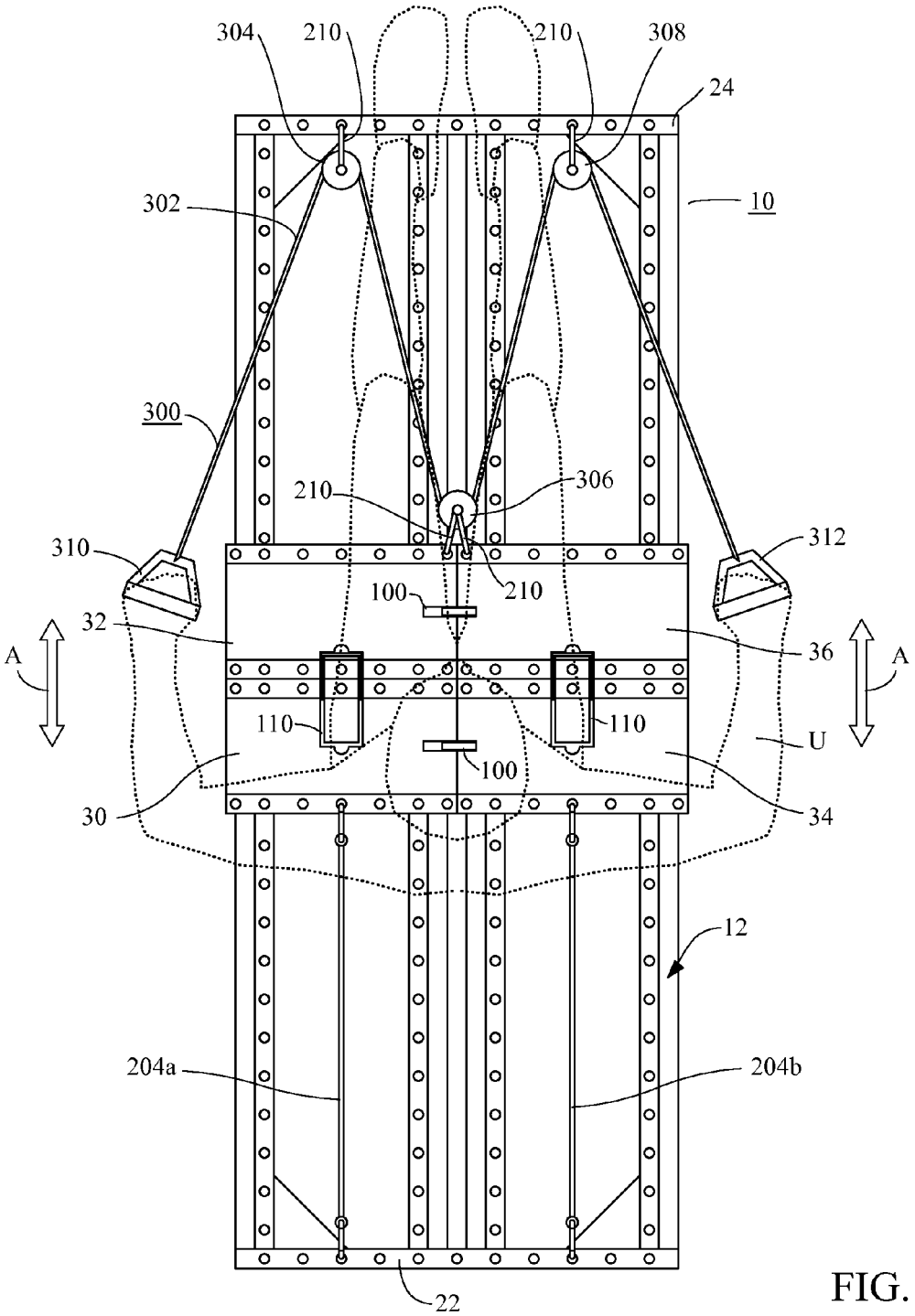
FIG. 7A illustrates a rowing exercise and FIG. 7B illustrates a pectoral muscle exercise that can be performed with an apparatus according to these embodiments of the invention.
Figure 7B:
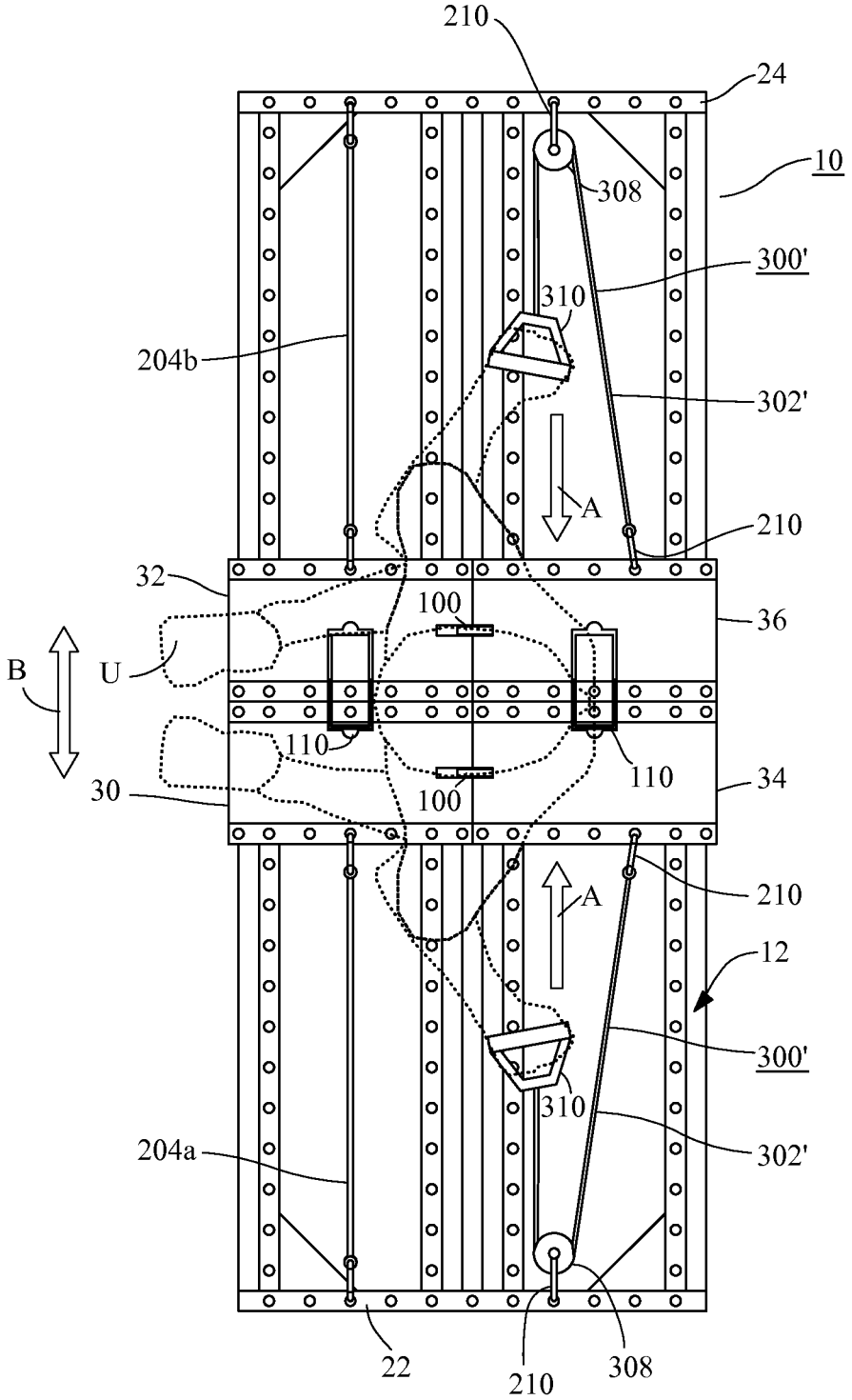

The apparatus 10 can also be used with a variety of pulley accessories, both with and without elastic resistance members, to perform different exercises. FIGS. 7A and 7B illustrate two pulley accessories that can be connected between the platforms and the frame to enable two different exercises. FIG. 7A shows a configuration in which the apparatus 10 is used for a seated rowing exercise. A first pulley accessory 300 comprises a cord 302 assembled with three pulleys 304, 306 and 308. and each end of the cord terminates in a handle 310 and 312 gripped by the user U. The first and third outside pulleys 304 and 308 each includes a clip 210 that enables the user to attach the associated pulley to a through-hole 40 in the cross brace 24. In the embodiment depicted in FIG. 7A, the first pulley 304 is attached to the cross brace at a through-hole 40 midway between the rails 14 and 16, and the third pulley is attached to a through-hole 40 midway between the rails 18 and 20. The second, intermediate pulley 306 has two clips 210 associated with it and one of the clips is attached to the inside-most through-hole 42 in the platform 32 while the other clip 210 is attached to the inside-most through-hole 42 in the platform 34. These connections of the pulleys to the cross braces 22 and the platforms ensures that the force on the platforms exerted by the pulley 308 is parallel to the rails when the user pulls back on the handles 310 and 312 in a rowing motion represented by the arrows A in the figure.

In this configuration all four platforms 30, 32, 34 and 36 are interlocked using their respective transverse interlocks 100 and longitudinal interlocks 110 to form a seat for the user. Two intermediate length elastic bands 204*a* and 204*b* are connected between the first cross brace 22 and the platforms 30 and 34, respectively, to provide resistance to movement of the seat formed by the platforms toward the second cross brace 24. The user U, positioned as shown in FIG. 7A, pulls on the handles 310 and 312 against the resistance provided by the elastic bands 204*a* and 204*b*. Additional bands can be added to increase the resistance to movement of the platforms, thus increasing the intensity of the rowing exercise. In another exercise using this configuration, the end of the frame 12 where the cross brace 24 is located can be elevated so that the user is pulling his or her weight. In addition, a modified rowing exercise can be performed in which the user pulls himself or herself with one hand while holding the other hand stationary.

FIG. 7B shows another pulley accessory 300' that includes two cords 302', each having a handle 310 at one end and a clip 210 at the other end. A pulley 308 disposed intermediate the ends of the cord includes a clip 210 for attaching it to one of the through-holes; in the case of the exercise described here the pulleys attach to the cross braces 22 or 24, respectively. As in FIG. 7A, all four platforms 30, 32, 34, and 36 are interlocked, and intermediate length elastic bands 204*a* and 204*b* are connected between the interlocked platforms and respective cross braces 22 and 24. The user U kneels on the platforms and exercises his or her pectoral muscles by alternately pulling the handles 310 across his or her body in the direction of arrows A, which moves the platforms back and forth in the direction of arrow B against the resistance provided by the elastic bands.

Those skilled in the art will immediately appreciate from those two exemplary pulley accessories many other ways of connecting pulley-and-cord arrangements to enable myriad other exercises. For example, the pulley accessory in FIG. 7B can be connected as in the FIG. 7A configuration, but with the cords connected directly to the platforms instead of passing over a pulley. This would enable another type of rowing exercise to be performed. In addition, the pulleys in the FIG. 7B embodiment could be connected to the cross braces 22 and 24 at their midpoints, the user could hold his or her hands more upright and exercise the bicep muscles one arm at a time. Or, with that same pulley connection, the user could stand on the platforms with his or her arms outstretched and exercise the deltoid muscles one side at a time. This versatility in the manner which various accessories can be connected to the basic apparatus comprising the platforms and frame is one of the hallmarks of the present invention.

Figure 8:
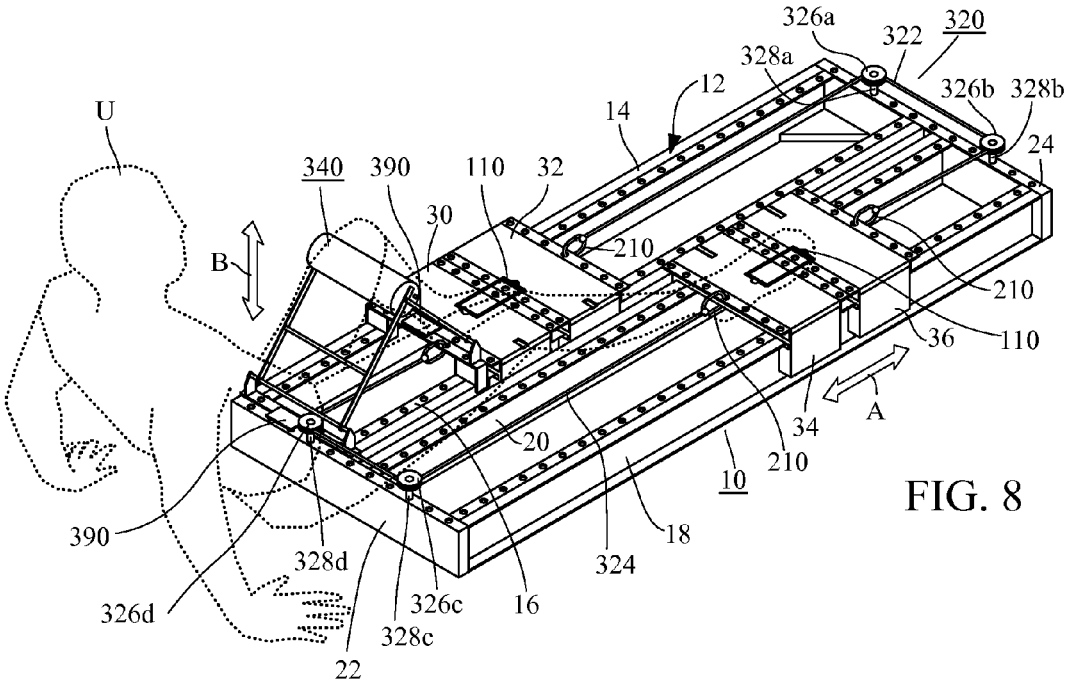
FIG. 8 is a plan view of the apparatus in FIG. 1 with another alternate pulley system installed between the platforms and one possible use of this pulley system with a therapeutic appliance.

FIG. 8 illustrates another pulley accessory 320 mounted to the apparatus 10 to enable the user U to perform physical therapy on a knee joint. The pulley accessory includes two identical cords 322 that have clips 210 at their ends, and four identical pulley assemblies. Each pulley assembly includes a pulley 326*a*, 326*b*, 326*c* and 326*d* and an extended axle portion 328*a*, 328*b*, 328*c* and 328*d*. The ends of the axle portions fit snugly into the through-holes 42 in the cross braces 22 and 24. The axle portions can include a circumferential rib (not shown) that limits the distance the axle extends into an associated through-hole 40, and a spring-loaded catch (not shown) at its end that retracts as the extended axle is inserted into the hole 40 in the flange of the cross brace and then cooperates with the underside of the flange to hold the axle and the pulley in place. An exercise apparatus 10 as shown in FIG. 1 is configured with the two pairs of longitudinally facing platforms 30, 32 and 34, 36 interlocked using their respective longitudinal interlocks 110. One cord 322 is connected to the platform 32 by inserting the clip 210 into an associated through-hole 42 and the cord travels over a first set of pulleys 326*a* and 326*b*, with its other end connected to a through-hole in the platform 36. The other cord 324 is connected to the platform 30 by inserting the clip 210 into an associated through-hole 42 and the cord travels over a second set of pulleys 326*c* and 326*d*, with its other end connected to a through-hole 42 in the platform 34.

Figure 9:
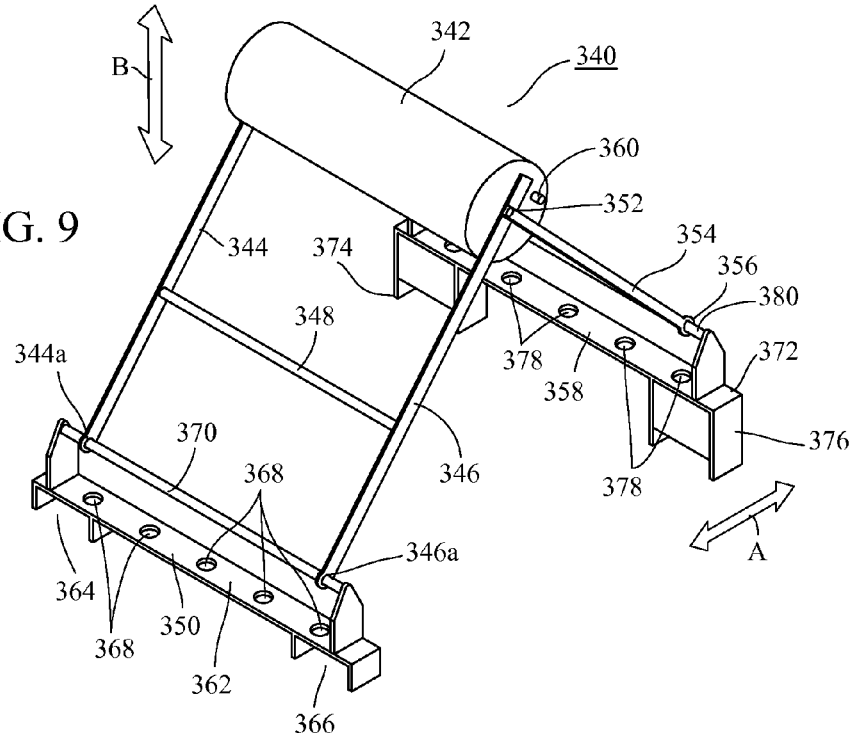
FIG. 9 is a detailed isometric view of the therapeutic appliance installed on the apparatus in the configuration shown in FIG. 8 that enables the apparatus to be used for a physical therapy exercise for a user's knee joint.

The apparatus in this configuration can be used to provide physical therapy to a knee joint of the user U by using the therapeutic appliance 340, shown in more detail in FIG. 9. The user positions himself on the floor at one end of the apparatus 10 set up as in FIG. 8 with a knee resting on the pad 342 of the appliance. Here it is the left knee being exercised, and the user uses his right foot to move the interlocked platforms 34 and 36 to and fro on the rails 18 and 20 in the direction of arrow A. These interlocked platforms provide an active member that causes the interlocked platforms 30 and 32 to act as a passive exerciser that moves to and fro on the rails 14 and 16 to flex and extend the user's left knee by raising and lowering the pad 342 in the direction of arrow B as described in more detail in connection with FIG. 9. It will be appreciated that cords of different lengths can be used to accommodate taller or shorter users, so that the pairs of interlocked platforms 30, 32 and 34, 36 are positioned along the rails to permit the apparatus to be used for its intended purpose. In addition, the apparatus in FIG. 8 can also be used with the foot strap accessory described in more detail below in connection with FIGS. 11 and 12 to provide the user with more control over the movement of the passive member formed by the interlocked platforms 30, 32.

FIG. 9 shows the details of the therapeutic appliance 340 and a linkage that converts longitudinal movement of the interlocked platforms 30, 32 in the direction of arrow A into vertical motion of the pad 242 in the direction of arrow B. More specifically, a first pivot frame includes pivot arms 344 and 346 connected at their midpoints by a brace 348 to increase the rigidity of the first frame. One end of each arm is pivotally attached to a first mounting bracket 350 to be described in a moment at circular openings 344*a* and 346*a* formed at the end of the respective arms 344 and 346. Proximate to their other ends the arms are attached at a pivot point 352 to an axle (not shown) disposed interiorly along the axis of the cylindrical pad 342. A second pivot frame 354 is similarly mounted at one end to the axle of the pad 342 and at the other end by circular openings 356 to a second mounting bracket 358 that will also be described shortly. The pivot frame arms pivot relative to each other at the attachment point 352 and the pivot arms 344 and 346 extend slightly beyond the attachment point 352 to the axle so that nearer to their ends they will hit limit stops 360 (only one of which is shown in the drawing) on the end faces of the cylindrical pad 342 as the pad 342 lowers in the direction of arrow B. This provides a safety feature that limits the range of motion to which the user's knee is subjected during therapy.

The first mounting bracket 350 has a bracket frame 362 with rail guides 364 and 366 at each end. The rail guide 364 fits over the rail 14 and the rail guide 366 fits over the rail 16, in accordance with the depiction in FIG. 8. The bracket frame 362 has through-holes 368 that line up with the through-holes 40 in the cross brace 22 when the rail guides 364 and 366 are in place on the rails 14 and 16. A rod 370 on the bracket frame 362 extends through the openings 344*a* and 346*a* in the pivot frame arms 344 and 346 to permit the arms to pivot freely about the rod 370. The second mounting bracket 358 is constructed similarly, having a bracket frame 372 with rail guides 374 and 376 at each end that fit over the rails 14 and 16, respectively. The bracket frame 372 has through-holes 378 that line up with the through-holes 42 associated with the platform 30 when the rail guides 374 and 376 are in place on the rails 14 and 16. The rail guides 374 and 376 include spacers 374*a* and 376*a* to raise the top surface of the bracket frame 372 above the rails so that it is flush with the top surface of the platform 30 when the bracket 358 is in place on the rails 14 and 16. A rod 380 on the bracket frame 372 extends through the openings 356 in the pivot frame arms 354 to permit the arms to pivot freely about the rod 380.

As seen in FIG. 8, the appliance 340 in use rests on the rails 14 and 16 with its first mounting bracket 350 removably connected to the cross brace 22 and its second mounting bracket removably connected to the platform 30. FIG. 10 shows an embodiment of a connector suitable for the purpose, depicted in an exploded isometric view that illustrates how it cooperates with the first mounting bracket frame 362 and the cross brace 22. (Parts of the mounting bracket 350 other than the bracket frame 362 are omitted from FIG. 10 for clarity.) The connector comprises a top plate 390 that has depending pins 392 at its corners. The plate and pins are dimensioned so that the pins fit into the holes 40 in the cross brace 22 and the holes 368 in the bracket frame 362. In the embodiment shown. two pins fit into the holes 40 and two pins fit into the holes 368, but the plate can be provided with more pins and dimensioned so that there are more than two connection points between the bracket 350 and the cross brace 22. The second mounting bracket 358 is connected to the platform 30 by an identical connector, as indicated in FIG. 8. In an alternate configuration the pins 392 can include a catch mechanism that positively holds them in the holes, but it is expected that gravity wand friction will be sufficient to hold them in place during this exercise.

The pulley accessories described herein, as well as the therapeutic appliance 340 adapted to be used with a particular pulley accessory, further illustrates the versatility of the present invention. For example, not only can it be used to actively exercise muscles by providing resistance to movement, it can also provide for passive movement of joints after surgery or injury to administer physical therapy to rehabilitate the injured joint.

Handles.

Figure 11:
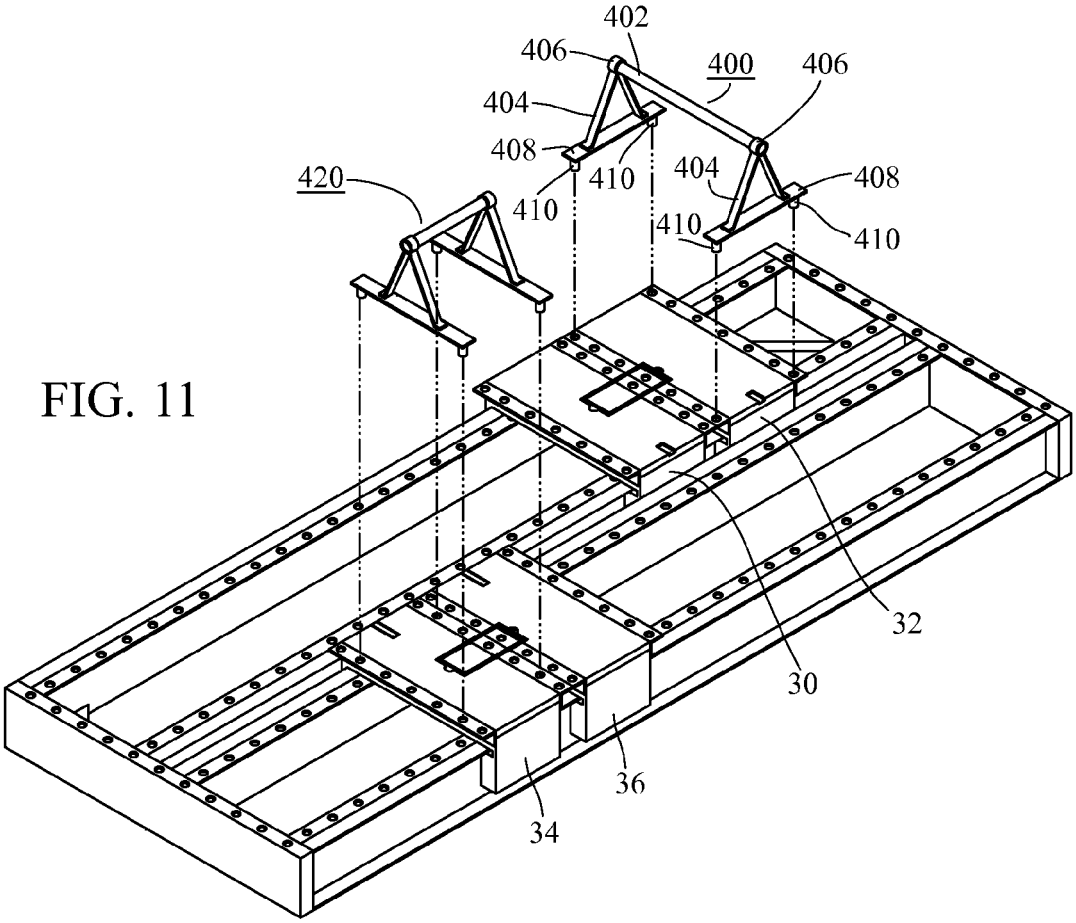
FIG. 11 is an exploded isometric view of the apparatus in FIG. 1 showing how removable handles can be secured to one or more of the platforms for desired exercise modalities.
Figure 12:
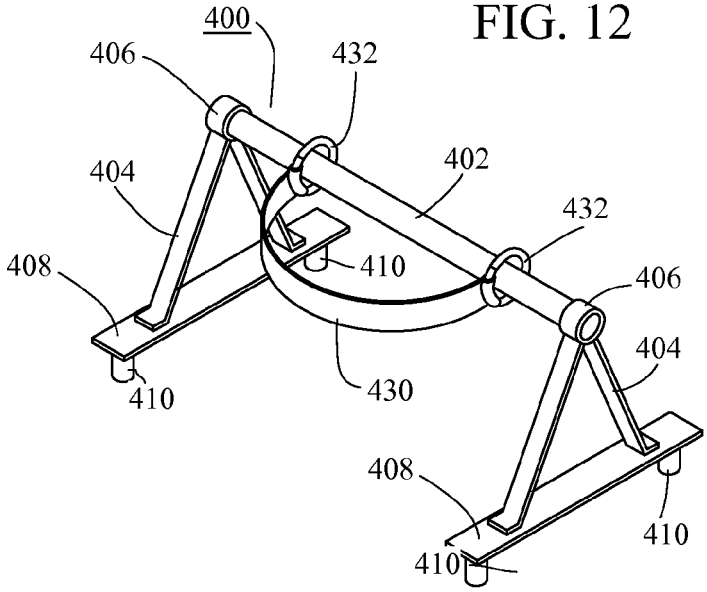
FIG. 12 is an isometric view of one of the handles in FIG. 11 with a removable foot strap attached to it for different exercise modalities.

FIGS. 11 and 12 illustrate additional accessories that further increase the utility of an apparatus according to the present invention, such as the apparatus 10 shown in FIG. 1. In particular, FIG. 11 shows two types of handgrip accessories that attach to a platform 30, 32, 34, or 36 to provide a handle for a user performing an exercise. In FIG. 11 the handgrips are shown in an exploded view to illustrate how they mount to a platform. (FIG. 11 shows the platforms 30 and 32 and the platforms 34 and 36 interlocked, but each handgrip mounts to a single platform.) Taking the transverse handgrip 400 shown mounting to the platform 32 first, a handle bar 402 spans two end brackets 404, each of which comprises two legs that connect at an apex where a ring 406 holds the handle bar 402 at the ends thereof. The end bracket legs are connected at the ends thereof opposite the apex to a base 408 to form therewith a handgrip frame. Four mounting posts 410 on the undersides of the bases 408 at their respective ends fit into through-holes 42 at the corners of the cooperating platform, here platform 32. The phantom lines in FIG. 11 illustrate how the handgrips are dimensioned so that the mounting posts 410 match up with the appropriate holes 42 in the platforms to mount the handle bar transverse to the direction of motion of the platforms. The mounting posts can include spring-loaded catches (not shown) that releasably engage the underside of the flanges 60 with the through-holes 42 to more positively attach the handgrips 380 to the platforms and prevent the handgrip from separating from the platform during an exercise. The handgrip handle bar 402 extends transverse to the rails when in place on a platform, and can be used in various exercise, such as the pectoral fly illustrated in FIG. 6C.

Another version of a handgrip is embodied in the longitudinal handgrip 420 shown in FIG. 11. In this version, the handle bar extends along the direction of movement of the platform to which the hand grip in mounted. The handgrip 420 is constructed similar to the handgrip 400 and mounts to a platform in essentially the same fashion, except that the handle bar is disposed along the direction of motion of the platforms along the rails. Accordingly, a detailed description of the handgrip 420 is not necessary to an understanding of its construction and use.

FIG. 12 shows a foot strap 430 attached to the handgrip 400 to enable a user to move a platform to and fro with his or her foot. For example, this foot strap accessory will enable a user to have more control over the movement of a platform using his or her feet, such as while performing an exercise with the therapeutic appliance 400 illustrated in FIG. 8. The foot strap 430 can be any suitable material such as a plastic, rubber, or leather and has a ring 432 on either end that encircles the handle bar of the handgrip. The foot strap 430 can be permanently attached to the handle bar since most users will not find it inconvenient to use the handgrip as a handle even with the foot strap present, but the rings 432 can be made releasable so that the foot strap can be removed if desired. It will be understood that the handgrip 420 can also incorporate a foot strap. In another variation, the foot strap rings can be connected directly to a platform by the releasable carabiner-type clips 210 described above.

Weights.

Figure 13:
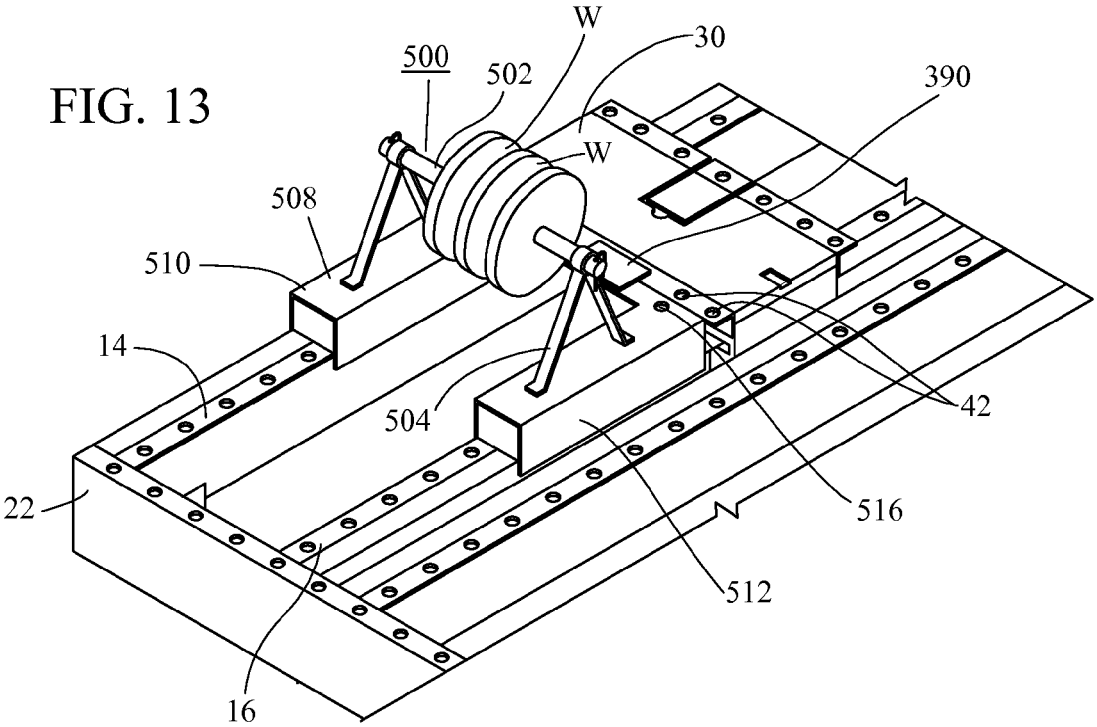
FIG. 13 is an isometric view of an accessory for adding weights to the apparatus in FIG. 1 to provide resistance to movement of one of the platforms.
Figure 14:
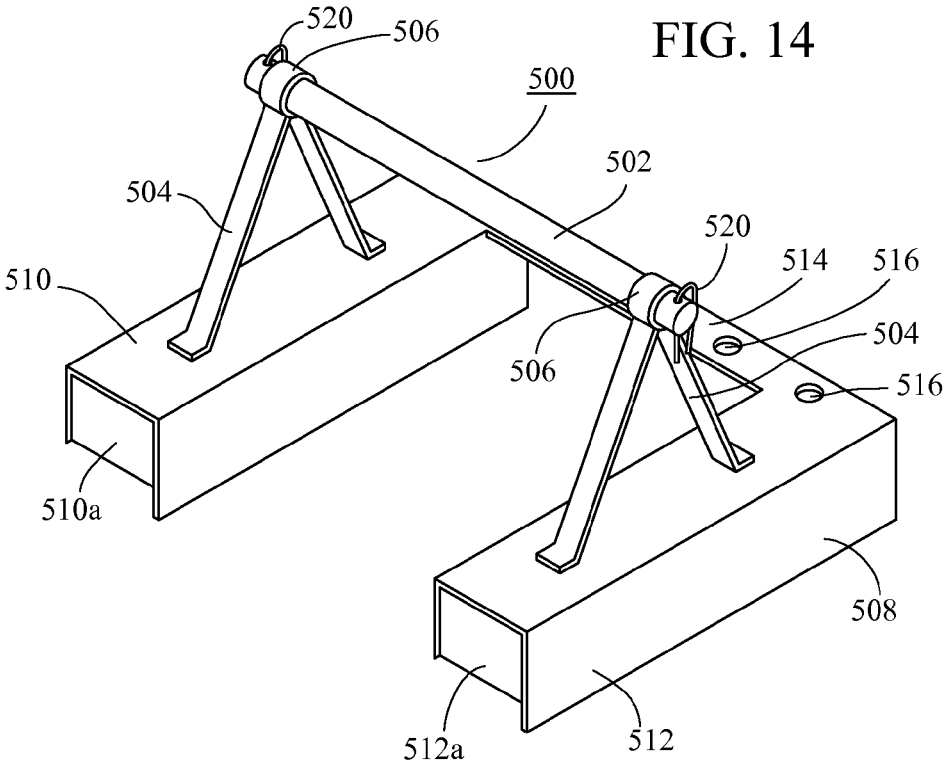
FIG. 14 is a detailed isometric view of the accessory shown in FIG. 13 without the weights.

Another variation of the invention uses an accessory by which resistance to movement of the platforms can be provided by varying amounts of weight. FIGS. 13 and 14 show a weight accessory 500 in which a weight bar 502 spans two end brackets 504, each of which comprises two legs that connect at an apex where a ring 506 accepts the weight bar at the ends thereof. The ends of the legs opposite the apex are connected to in a suitable fashion to a base 508. To ensure rigidity and durability, the connection is preferably made by turning up the ends of the legs as shown most clearly in FIG. 14 and welding them to the base 508. The base 508 is an integral unit with two rail guides 510 and 512 connected by a cross piece 514. The rail guides are spaced apart a distance that matches the distance between the rails of a track of the apparatus, namely rail pairs 14, 16 and 18, 20. Thus, the weight accessory 500 rests on the rails of a given track for sliding movement along the rails, as can be appreciated from FIG. 13. The rail guides include spacers 510*a* and 512*a* to raise the top surface of the cross piece 514 above the rails so that it is flush with the top surface of the platform to which it is to be connected (platform 30 in FIG. 13). The cross piece 514 has through-holes 516 that line up with the through-holes 42 in the platform to which the weight accessory is to be connected. The connector described above in connection with FIG. 10 can conveniently be used for this connection, as shown in FIG. 13.

The weight bar 502 is removable from the brackets by sliding it through the rings 506 to mount weighted plates W (not shown in FIG. 14) on the bar. Typically, a plate W will have a predetermined weight, and most conveniently comprises a standard weighted disc available commercially from many sources, one being Iron Grip Barbell Co., of Santa Ana, Calif., in weights of 1¼, 2½, 5 and 10 pounds. The weight bar 502 is secured in the rings 506 by spring clips 520 having one leg that fits into a hole through a diameter of the weight bar at an end outside the ring and another leg that clips over the bar to hold the clip in place. The clips are intended only as examples of how the weight bar can be secured in place to provide a weight accessory in accordance with the invention. Those skilled in the art will immediately appreciate that other ways of mounting a desired amount of weight are possible within the scope of the present invention.

One or more of the weight accessories 500 can be used in conjunction with elastic bands or on their own to provide resistance to movement along the rails of the platform to which a weight accessory is connected. For example, the weight accessory can be used for any of the exercises depicted in FIGS. 5, 6, and 7. Some users will prefer weights to elastic bands because a weight accessory according to the present embodiment provides a constant resistance to movement rather than the progressively increasing resistance provided by an elastic band as It is stretched. Further, a weight accessory like the present embodiment does not exert a force tending to restore its original length, and thus tend to return to its original position a platform to which it is connected. This tendency may make elastic bands unsuitable for some physical therapy modalities. Another advantage is that some users will find the ability to add progressively more weights as an exercise program proceeds makes it easier to track strength improvements.

Alternate Embodiments

In addition to the embodiments of the invention already described above and various accessories and appliances that can be used with it, variations in the apparatus itself are also possible within the scope of the invention.

Alternate Interlocking Mechanism.

FIG. 15 is an exploded isometric view of an alternate arrangement for selectively interlocking the platforms together. In this embodiment the platforms are interlocked using removable U-shaped clasps 600 that fit into slits 602 formed in the support plate 50 of each platform, as indicated by the phantom lines in FIG. 15. One advantage of this construction is its ease of manufacture as compared to the interlocking mechanism discussed above in connection with FIGS. 4 and 4A. The clasps also lie on the surface of the platforms instead of being flush as with the FIG. 4 interlocking arrangement. And although this alternate interlocking arrangement could be made so that the clasps lie flush with the platform surface. It would obviate to some extent the advantage gained by its ease of construction as depicted.

Another alternate interlocking mechanism comprises interlock connectors which, like the connector shown in FIG. 10, uses the through-holes 42 at the transverse sides of the platforms. One such platform interlock connector 610 is shown in FIG. 15 positioned to interlock all four platforms 30, 32, 34, and 36. The platform interlock connector 610 has an I-frame 612 with depending pins 614 at the ends of the cross legs of the "I." If the platform dimensions and the spacing of the through-holes are judiciously chosen, identical platform interlock connectors 610 can also be used as transverse and longitudinal interlocks. Used as transverse interlocks connecting the platforms 30 and 34 and/or the platforms 32 and 36, the pins 614 are inserted into through-holes 42 at the ends of the facing longitudinal sides of the platform(s) to be locked together. Used as longitudinal interlocks connecting the platforms 30 and 32 and/or the platforms 34 and 36, the platform interlock connectors are positioned so that the pins 614 enter through-holes 42 in adjacent transverse sides of the platforms. Alternatively, different platform interlock connectors can be dimensioned to match the through-hole placement in the particular platforms to be connected. In addition, the mounting pins 614 can include spring-loaded catches (not shown) that releasably engage the underside of the flanges 60 with the through-holes 42 to more positively attach the platform interlock connectors to the platforms.

Braking Mechanism.

Figure 16:
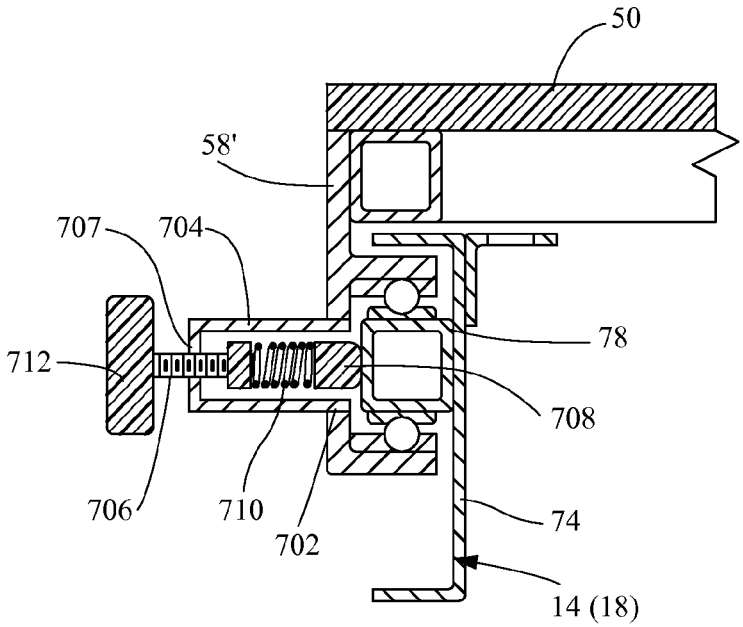
FIG. 16 is a partial cross section of a track showing with an optional braking mechanism that can be incorporated into the apparatus in FIG. 1 to apply a predetermined fixed resistance to movement of a platform.

FIG. 16 discloses an alternate embodiment for imparting resistance to movement of the platforms. A modified support bracket 58' has an opening 702 opposite the bearing support box girder 78 attached to the C-shaped channel girder 74 of an outer rail 14 or 18, as the case may be. (Details of the structure of an outside rail and of the bearing supporting the platforms are shown in FIG. 3.) A hollow cylindrical brake mount 704 is securely attached to the support bracket 56' within the opening 702. If both the support bracket and the brake mount are steel, they can be welded together to form a unit. A brake is provided by a threaded actuating rod 706 with external threads that mate with internal threads in an opening 707 at the proximal end of the brake support bracket 704. A brake shoe 708 made of a suitable friction material such as hard rubber is forced against the bearing support box girder 78 by a compression spring 710 disposed within the bore of the brake mount between a distal end of the actuating rod 706 and the box girder 78. An adjusting knob 712 on the proximal end of the actuating rod can be turned by a user to move the distal end of the actuating rod closer to or farther from the box girder. This compresses the spring 710 more or less and adjusts the braking force applied to the box girder that resists movement of the platform.

The braking mechanism according to this embodiment can be used instead of or in conjunction with the resistance adjusting accessories discussed above (the elastic bands and/or the weights) to provide even more versatility to the apparatus. For example, in cardiovascular workouts, a braking mechanism as in the present embodiment will provide a more constant resistance than elastic bands, which provide a variable resistance depending on how far they are stretched. In addition, the ability to finely adjust the resistance to movement using the knob 712 provides the ability to exert more finely calibrated resistance to movement than discrete weights or elastic bands.

SUMMARY

Thus, the present invention overcomes many of the shortcomings in prior art exercise apparatus and devices. As a result of its novel configuration, it can be placed in multiple configurations and used with multiple accessories and appliances to provide an almost limitless number of exercise and therapeutic modalities. From the above description it will be apparent that an apparatus in accordance with the principles of the invention and the construction of particular embodiments has a high degree of versatility imparted by selectively interlocking platforms and various ways of imparting resistance to movement thereof. It enables a wide variety of muscle groups to be exercised and enables low impact cardiovascular exercise. As a result, it has applicability in many different environments, including rehabilitation, fitness, sports training, and simulation of sport situations. The apparatus is convenient because it is compact, light weight, can be made in portable configurations, is easy to store, and requires no power.

While the above description mentions certain variations in the construction and operation of the exercise/therapeutic apparatus thus far described other variations are possible within the scope of the invention. Those skilled in the art will recognize that only selected preferred embodiments of the invention have been depicted and described, and it will be understood that various changes and modifications can be made other than those specifically mentioned above without departing from the spirit and scope of the invention, which is defined solely by the claims that follow.

What is claimed is:

1. An exercise apparatus comprising:

a base apparatus including:

a frame having at least two tracks, each comprising parallel rails connected at spaced apart locations by cross braces, wherein each of the rails and cross braces includes a plurality of connection points, four platforms mounted for sliding movement on the tracks independently of each other, wherein at least two platforms are mounted on a first track for movement independently of each other and at least two platforms are mounted on a second track for movement independently of each other and the platforms mounted on the first track, wherein each platform includes a plurality of connections points, and an interlocking mechanism for selectively connecting the platforms together, the interlocking mechanism including a transverse interlock for connecting a platform on the first track to a platform on the second track for movement together and a longitudinal interlock for connecting the platforms on the same track for movement together; and an accessory or appliance including at least one of the following:

a cord and pulley assembly comprising a plurality of pulleys removably and selectively connectable to the rails, cross braces and platforms at connection points thereof for enabling a user to propel at least one of the platforms with the cord, a handgrip including a handle bar spanning a first pair of end brackets that mount the handle bar at spaced-apart locations thereon, with the handle bar spaced from a handgrip base that is removably connectable to a platform at connection points thereof, a weight accessory including a weight bar spanning a second pair of end brackets that removably mount the weight bar at spaced-apart locations thereon, with the second pair of end brackets mounted to a weight accessory base that is removably mountable on one of the tracks for sliding movement along the rails thereof, the weight accessory base being removably connectable to at least one of the platforms at a connection point thereof for sliding movement along the rails with the platform, wherein the weight accessory further includes one or more weights selectively mountable on the weight bar, and a therapeutic appliance including (i) a first mounting bracket removably connectable to a cross brace at a connection point thereof, (ii) a second mounting bracket removably connectable to one platform at a connection point thereof, (iii) a therapeutic member connected between the first and second mounting brackets for movement with the second bracket, (iv) and a cord removably connectable to the one platform at a connection point thereof and to another platform at a connection point thereof, wherein the cord enables a user to move a body part with the therapeutic member by moving another platform.

2. An exercise apparatus as in claim 1, wherein all of the platforms have a substantially identical rectangular planform.

3. An exercise apparatus as in claim 1, wherein the frame includes a first cross brace connecting the rails together at one end of the frame and a second cross brace connecting the rails together at another end of the frame.

4. An exercise apparatus as in claim 3, wherein the connection points include through-holes along the cross braces and rails and in the platforms.

5. An exercise apparatus as in claim 4, wherein the through-holes in the cross braces and rails are uniformly spaced and the through-holes in the platforms are uniformly spaced.

6. An exercise apparatus as in claim 1, further comprising a plurality of elastic resistance members removably and selectively connectable to the rails, cross braces, and platforms at connection points thereof for enabling a user to select a resistance to movement of a platform along the rails.

7. An exercise apparatus as in claim 6, wherein each elastic resistance member comprises an elastic band with a clip at each end thereof and the connection points comprise through-holes along the cross braces and rails and in the platforms for accepting the clips therethrough to removably connect an elastic band to a rail, cross brace, or platform.

8. An exercise apparatus as in claim 7, wherein the plurality of elastic bands include elastic bands in at least two lengths when not under tension.

9. An exercise apparatus as in claim 1, wherein the pulleys of the cord and pulley assembly each include a clip and the connection points comprise through-holes along the cross braces and rails and in the platforms for accepting the clips therethrough to removably connect a pulley to a rail, cross brace, or platform.

10. An exercise apparatus as in claim 1, wherein the handgrip base comprises at least four depending mounting posts, and the connection points comprise through-holes in the platforms for accepting the mounting posts therein.

11. An exercise apparatus as in claim 10, wherein a first handgrip type mounts to the platform with the handle bar disposed generally transverse to the direction of movement of the platform along the rails and a second handgrip type mounts to the platform with the handle bar disposed generally in the direction of movement of the platform along the rails.

12. An exercise apparatus as in claim 10, wherein a foot strap is mounted to the handle bar for enabling a user to move the platform along the rails with his or her foot.

13. An exercise apparatus as in claim 1, wherein:

the weight accessory base comprises a pair of rail guides for resting on the rails of one of the tracks; and the connection points comprise through-holes in the platforms and through-holes in the base, the weight accessory further including a connector with depending posts removably accepted by the through-holes for connecting the weight accessory to a platform.

14. An exercise apparatus as in claim 1, wherein:

the therapeutic appliance further includes (i) at least four pulleys, each having a depending axial mounting post, (ii) two cords with a clip at each end thereof, the connection points comprising through-holes along the cross braces for accepting the mounting posts therein to removably mount the pulleys to the cross braces and through-holes in the platforms proximate to the transverse sides thereof for accepting the clips therethrough to removably connect a cord to a platform, (iii) a first connector with depending posts removably accepted by through-holes in the first mounting bracket for connection thereof to a cross brace, and (iv) a second connector with depending posts removably accepted by through-holes in the second mounting bracket for connection thereof to the one platform, and the therapeutic member comprises a cylindrical pad connected by a linkage to the first and second mounting brackets for converting motion of the second mounting bracket in the direction of the rails into motion of the cylindrical pad transverse to the plane of the rails.

15. An exercise apparatus as in claim 14, wherein:

the platforms on the same pair of rails are interlocked;

a first transverse side of the interlocked platforms on a first pair of rails is connected by one of the cords passing over two of the pulleys mounted to a first cross brace to a first transverse side of the interlocked platforms on a second pair of rails, and a second transverse side of the interlocked platforms on the first pair of rails is connected by one of the cords passing over two of the pulleys mounted to a second cross brace to a second transverse side of the interlocked platforms on the second pair of rails; and the first mounting bracket is connected to the first cross brace and the second mounting bracket is attached to the interconnected platforms on the first pair of rails, with the cords having lengths that permit a user positioned proximate to the first cross brace to place one of his or her knees on the pad and move the interlocked platforms on the second pair of rails with his or her other foot.

16. An exercise apparatus as in claim 1, wherein the transverse and longitudinal interlocks comprise slits in the surfaces of the platforms and U-shaped clasps that fit into the slits in adjacent platforms.

17. An exercise apparatus as in claim 1, wherein:

through-holes are disposed along the cross braces and rails and in the platforms; and the transverse and longitudinal interlocks include a platform interlock connector for cooperating with through-holes in adjacent platforms.

18. An exercise apparatus as in claim 1, further comprising an adjustable braking mechanism including a brake mount attached to one of the platforms and a movable actuating member carried by the brake mount for adjusting the force applied by a brake shoe on a rail mounting the platform.

19. An exercise apparatus comprising:

a frame having at least two substantially parallel tracks;

four platforms mounted for sliding movement on the tracks independently of each other, wherein at least two platforms are mounted on a first track for independent movement and at least two platforms are mounted on a second track for independent movement adjacent to the platforms mounted on the first track; and an interlocking mechanism for selectively connecting the platforms together, the interlocking mechanism including a transverse interlock for connecting a platform on the first track to a platform on the second track for movement together and a longitudinal interlock for connecting the platforms on the same track for movement together, wherein:

the transverse interlock comprises a slider and slots open to the edges of the opposite longitudinal sides of the platforms for accepting the slider, and the longitudinal interlock includes a latch hinged to one of the two platforms on a respective track and a groove in the surface of the other of the two platforms on the respective track for accepting the latch therein.

20. A method of providing physical therapy to a knee joint using an exercise apparatus comprising a frame with two tracks, each including a pair of rails parallel to each other and to the rails of the other track, and cross braces connecting the rails at respective ends of the frame, and first and second platforms mounted for sliding movement on respective tracks, the method comprising:

connecting the platforms for movement of one platform along the track on which it is mounted in response to movement of the other platform along the track on which it is mounted;

providing a therapeutic appliance with a knee pad connected by a linkage to first and second base members for movement of the knee pad in a vertical direction in response to relative movement of the base members in a horizontal direction;

connecting the first base member to a cross brace and the second base member to a platform; and placing a knee joint over the pad and moving the other platform with a foot to flex and extend the knee joint.

* * * * *